US009132330B2

(12) United States Patent
Brendle

(10) Patent No.: US 9,132,330 B2
(45) Date of Patent: Sep. 15, 2015

(54) VERTICAL FITNESS APPARATUS AND METHOD OF EXERCISING

(75) Inventor: Douglas Brendle, Cheyenne, WY (US)

(73) Assignee: FITWALL VENTURES LLC, Portland, OR (US)

( * ) Notice: Subject to any disclaimer, the term of this patent is extended or adjusted under 35 U.S.C. 154(b) by 828 days.

(21) Appl. No.: 13/255,840

(22) PCT Filed: Mar. 11, 2010

(86) PCT No.: PCT/US2010/027064

§ 371 (c)(1),
(2), (4) Date: Sep. 9, 2011

(87) PCT Pub. No.: WO2010/105113

PCT Pub. Date: Sep. 16, 2010

(65) Prior Publication Data

US 2011/0319230 A1 Dec. 29, 2011

Related U.S. Application Data

(60) Provisional application No. 61/159,155, filed on Mar. 11, 2009.

(51) Int. Cl.
*A63B 9/00* (2006.01)
*A63B 17/00* (2006.01)
(Continued)

(52) U.S. Cl.
CPC ..... *A63B 69/0048* (2013.01); *A63B 23/03541* (2013.01); *A63B 23/1218* (2013.01);
(Continued)

(58) Field of Classification Search
CPC .. A63B 9/00; A63B 69/0048; A63B 21/1426; A63B 21/00047; A63B 23/03541; A63B 23/1218; A63B 23/1236; A63B 2225/107; A63B 2021/169; A63B 1/00
USPC ..... 482/23, 35–37; 472/116
See application file for complete search history.

(56) References Cited

U.S. PATENT DOCUMENTS 6,074,327 A * 6/2000 Franklin ..... 482/37
6,231,482 B1 * 5/2001 Thompson ..... 482/37
(Continued)

FOREIGN PATENT DOCUMENTS

JP 10277189 4/1997
JP 2007307319 11/2007

OTHER PUBLICATIONS

International Search Report for related International Application No. PCT/US2010/027064 mailed Nov. 4, 2010. (4 pages).
(Continued)

*Primary Examiner* — Loan H Thanh
*Assistant Examiner* — Nyca T Nguyen
(74) *Attorney, Agent, or Firm* — Leason Ellis LLP

(57) ABSTRACT

A fitness wall panel has a height chosen to correspond with (1) the height of the user and/or (2) the environmental limitations of the containing room, producing a multifunctional exercise system. Large, rugged hand/foot holds and/or handles are removably bolted in the panel. Elastic straps, bands, ropes, chains, cables, platforms, bars and various other attachments can be mounted on the panel. Optional pulley systems and vibrators are mountable to the panel. Removable attachment of the foregoing devices creates a multitude of functional options and configurations, allowing a multitude of different exercise and training methods to be performed on one piece of equipment. Panels can be configured into arrays, projections or posts standing alone. Users work up and down and side to side doing exercises to perform full body and/or muscle specific or isolating exercises or any combination thereof in a limited space without exposure to dangerous height.

17 Claims, 32 Drawing Sheets

(51) Int. Cl.

| | |
|---|---|
| ***A63B 69/00*** | (2006.01) |
| ***A63B 23/035*** | (2006.01) |
| ***A63B 23/12*** | (2006.01) |
| *A63B 1/00* | (2006.01) |
| *A63B 21/00* | (2006.01) |
| *A63B 21/04* | (2006.01) |
| *A63B 21/055* | (2006.01) |
| *A63B 21/062* | (2006.01) |
| *A63B 21/068* | (2006.01) |
| *A63B 21/16* | (2006.01) |

(52) U.S. Cl.

CPC ..... *A63B 1/00* (2013.01); *A63B 21/00047* (2013.01); *A63B 21/0442* (2013.01); *A63B 21/0552* (2013.01); *A63B 21/062* (2013.01); *A63B 21/068* (2013.01); *A63B 21/1426* (2013.01); *A63B 23/1236* (2013.01); *A63B 2021/169* (2013.01); *A63B 2210/50* (2013.01); *A63B 2213/00* (2013.01); *A63B 2225/093* (2013.01); *A63B 2225/107* (2013.01)

(56) References Cited

U.S. PATENT DOCUMENTS

| | | | | |
|---|---|---|---|---|
| 6,514,178 | B2 * | 2/2003 | Vettori | 482/37 |
| 6,626,801 | B2 * | 9/2003 | Marques | 482/23 |
| 6,709,365 | B2 * | 3/2004 | Zeilinger | 482/35 |
| 7,056,266 | B2 * | 6/2006 | Sudeith | 482/37 |
| 7,520,838 | B1 * | 4/2009 | Sudeith et al. | 482/37 |
| 7,524,269 | B2 * | 4/2009 | Postma et al. | 482/37 |
| 7,611,444 | B1 | 11/2009 | Sudeith | |
| 7,731,632 | B2 * | 6/2010 | Wu | 482/37 |
| 7,762,928 | B2 * | 7/2010 | Meissner | 482/37 |
| 2002/0019297 | A1 * | 2/2002 | Vettori | 482/37 |
| 2002/0169052 | A1 * | 11/2002 | Godsey | 482/37 |
| 2003/0060333 | A1 | 3/2003 | Sudeith | |
| 2005/0245355 | A1 * | 11/2005 | Brewer et al. | 482/37 |
| 2008/0293547 | A1 * | 11/2008 | Moy et al. | 482/36 |

OTHER PUBLICATIONS

Written Opinion of the International Searching Authority for related International Application No. PCT/US2010/027064 mailed Nov. 4, 2010. (7 pages).

International Preliminary Report on Patentability for related International Application No. PCT/US2010/027064 issued Sep. 13, 2011. (8 pages).

FitWall T-10 Drawings of climbing wall product previously sold by Applicant. Climbing wall shown is admitted prior art to current climbing wall by Applicant. (available at least as of Mar. 10, 2008) (3 pages).

* cited by examiner

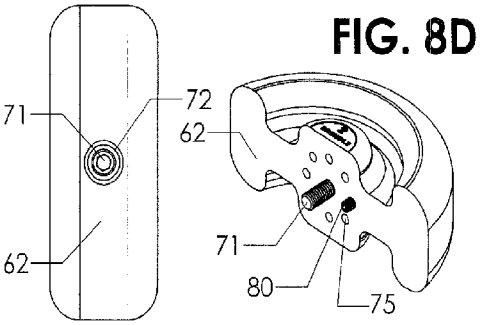
FIG. 8D
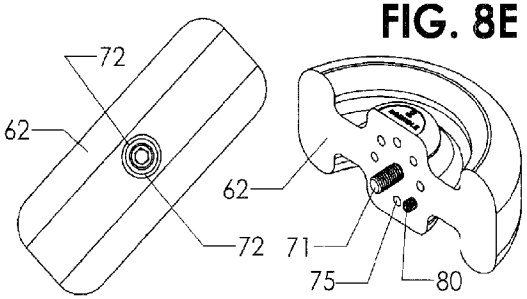
FIG. 8E
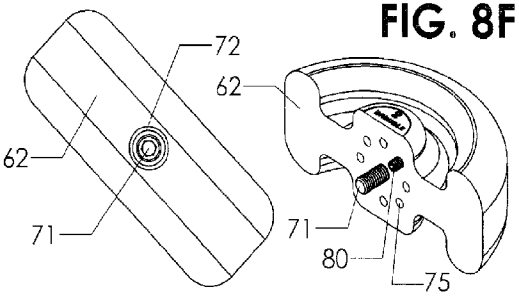
FIG. 8F
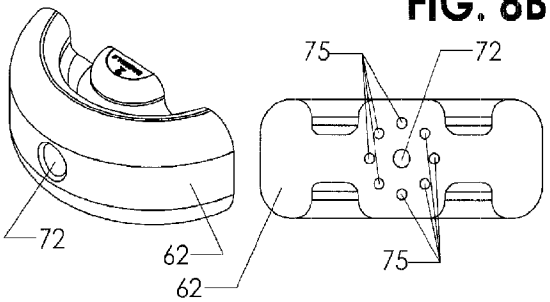
FIG. 8B
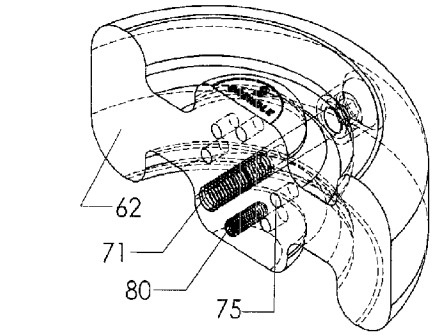
FIG. 8C
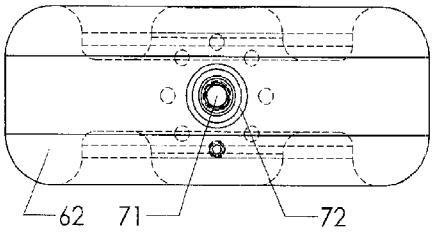

VERTICAL FITNESS APPARATUS AND METHOD OF EXERCISING

CROSS REFERENCE APPLICATIONS

This application is a non-provisional application claiming the benefits of provisional application No. 61/159,155 filed Mar. 11, 2009 which is hereby incorporated by reference for all purposes.

BACKGROUND

Simulated rock climbing walls are well known. Generally a climbing gym has a belay device to protect a climber from a fall from heights as high as twenty feet or more attached and supporting climber from directly above. Various hand and foot holds are generally small and challenging to find a grip to train the climber to be creative in ascending a simulated rock wall. Climbing walls are made to simulate the act of climbing a real rock surface and to help the user become a better climber. A traditional climbing wall is designed to force the climber up the wall in a slow and tedious manner requiring a lot of linear dimension of surface that the climber travels in a single forward direction, horizontally or vertically, and they generally only reverse the direction to dismount the wall.

Climbing wall holds are made to simulate the type of grip or hold you can achieve on a real rock surface and are not easy to hold on to. Sometimes takes several minutes to find a way to hold on to it. This makes the use of a climbing wall limited to climbing and if done correctly specifically duplicates only the act of climbing a real rock surface.

The foregoing example of the related art and limitations related therewith are intended to be illustrative and not exclusive. Other limitations of the related art will become apparent to those of skill in the art upon a reading of the specification and a study of the drawings.

SUMMARY

The main aspect of the present disclosure is to provide a modular fitness wall system which uses well anchored, close together hand and foot holds and/or handles to promote repetitive exercises done at differing levels off the floor working up and down and/or along the wall while changing exercises at any level of speed or intensity.

Another aspect of the present disclosure is to provide the wall segment with a series of anchor points for elastic bands and tubes, straps, chain, cables, platforms, beams, bars and the like to provide a combination and multitude of varying exercises methods to be done on the same vertical panel.

Another aspect of the present disclosure is to provide an optional cable and counterbalance option for the wall segment.

Another aspect of the present invention is to provide an interlock capability to easily mount a series of wall segments next to each other in proper alignment and spacing with each other without the need for further measuring, thereby saving valuable time in installation.

Another aspect of the present invention is to provide an attachment method to easily and quickly add exercise attachments to the fitness wall without tools or pins while locking the attachments in a solid and static position. The attachment method allows attachments to be repositioned quickly between exercises or for different exercises or methods of exercising.

Another aspect of the present intervention has innovative attachments allowing new more exercises and exercise methods to be done and developed.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

Each wall segment has a chosen height for the user such as, but not limited to, ten feet for an adult and six feet for a child. After fastening to a wall a safety mat can be placed under the wall segment if required for use by children or required for a specific environment. Various shapes of hand and foot holds are bolted into preset holes. Each hand/foot hold has a central bolt and an anti rotation pin which fits into an alignment hole adjacent the bolt hole and serves as second anchor to eliminate the holds ability to rotate even if the anchor bolt becomes loose. An optional tilt assembly allows a forward or reverse incline to be set to quickly change the dynamic forces while doing the same exercise.

The hand/foot holds are relatively large or ergonomically shaped, as are the handles and other attachments, to allow comfortable repetitive exercise while working systematically from level to level and then repeating while remaining off the ground.

The fitness wall forces the user to both fight against gravity by moving and holding the user's entire body (torso, head and limbs) above the floor while using their whole body to maintain sufficient core balance to keeping from breaking their grip and coming off the wall.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

FIGS. 8B, 8C, 8D, 8E, 8F are rear perspective and front views of hand hold with locking pin in different positions changing angle of hand hold.

FIG. 9 is a rear perspective view of the wall segment with a hand hold bolted on.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
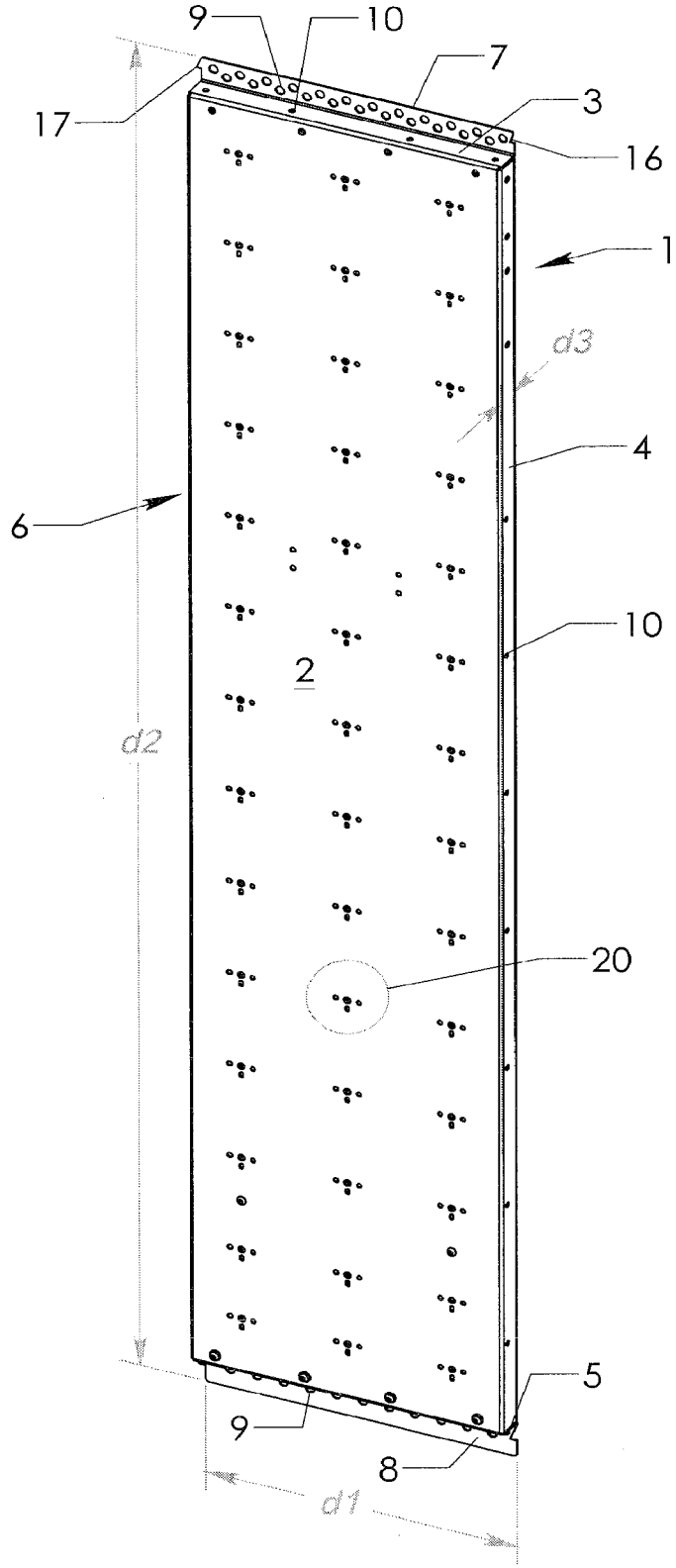
FIG. 1 is a front perspective view of one wall segment.
Figure 2:
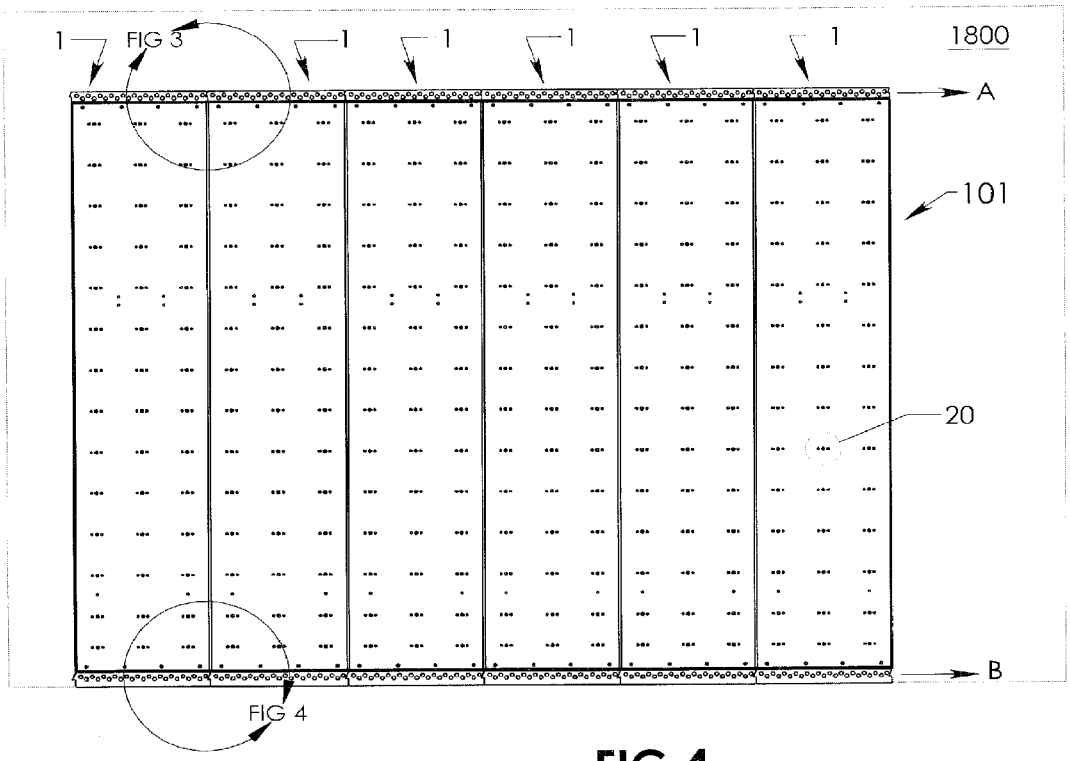
FIG. 2 is a front elevation view of a rack of wall segments.

Referring first to FIG. 1 a fitness wall panel 1 has a main plate 2, set off perimeter flanges 3, 4, 5, 6 and mounting flanges (which can be thought of as being mounting brackets) 7, 8. Nominal dimensions are d1=24", d2=12' (or nominally smaller as for example 8 feet, 6 feet or 4 feet for children), d3=2". In the depicted embodiment a single sheet of metal is used to form members 2, 3, 4, 5, 6, 7, 8. Both steel and aluminum are believed to work well for the metal. Mounting holes 9 are used to affix panel 1 to a wall 1800 shown in FIG. 18. Flanges 7 and 8 have a universal pattern of holes 9 that will coincide with various wall stud widths to allow the panel to be anchored onto a multitude of possible installation locations without having to alter the fitness wall panel to conform to the construction of the supporting wall or structure's available anchor points. The pattern of holes 9 allows the panel 1 to be shifted side to side while maintaining more than one hole 9 of the flange 3, 4, 5, 6 aligning with structural members of the supporting wall or structure to anchor the fitness wall panel 1 to the installation location. The hole to hole vertical centers are ½ inch or less and the horizontal centers are ¾" or more offset to maintain universal application. Holes 10 in flanges 2, 4, 6 are used as anchor holes for brackets and fixtures for connecting attachments such as, but not limited to, carabineers, platforms, bars, elastic straps that expand the use of the fitness wall. Each hole grouping 20 in main plate 2 can support a climbing hold or multitude of attachments. The spacing and number of hole groupings 20 is a design choice. An important part of the disclosed fitness wall and many methods of exercising performed on the wall are that the user has to use their core body muscles to hold them off of the floor against the force of gravity. This differs from prior art exercising systems in that prior art system do not have the user hold themselves off the ground while performing an extended set of exercises in a rapid and repetitive manner.

Figure 3:
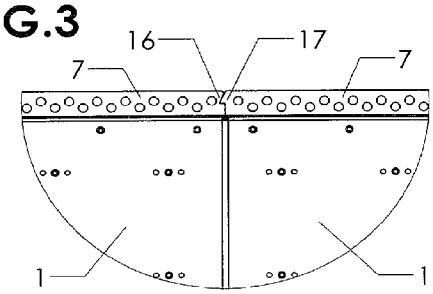
FIG. 3 is a close up view of the top joint labeled D of FIG. 3.
Figure 4:
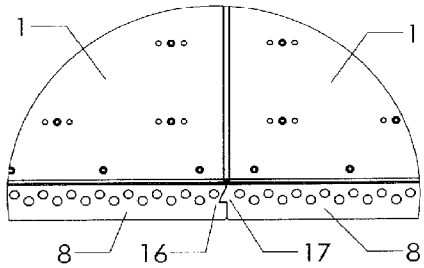
FIG. 4 is close up view of the bottom joint labeled E of FIG. 3.
Figure 5:
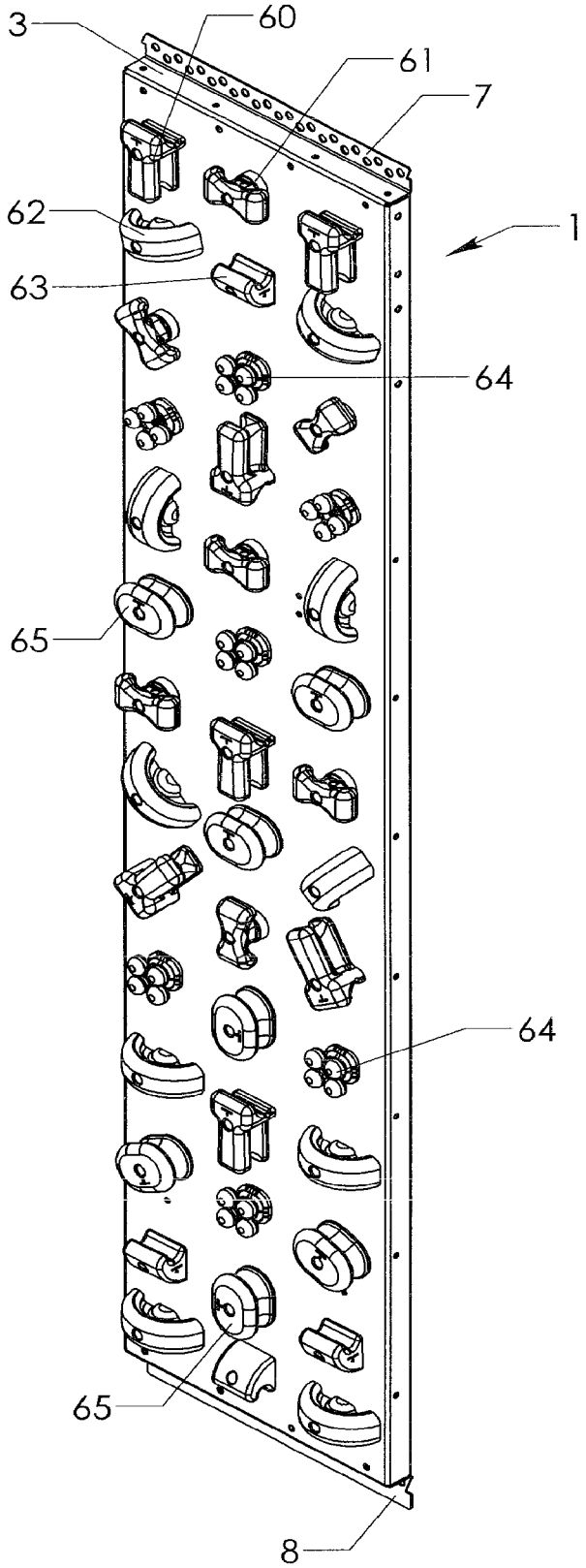
FIG. 5 is a front perspective view of the wall segment loaded with hand/foot holds.

Referring next to FIGS. 3, 4, 5 panels 1 are mounted abutting one another on wall 1800. The array 101 can be formed with any desired number of panels 1. This allows users to move across the array 101 as well as up and down and broadens the amount of exercises that can be done in relation to specific configuration of the system or allows for multiple users at one time. Each panel 1 has an alignment mechanism at the each side of the top and bottom flanges 7, 8 to allow the panels 1 to be aligned with next panel 1 in an array 101. The top flanges 7 and bottom flanges 8 have interlocking tongues 17 and grooves 16 in the depicted embodiment. A tongue 17 and groove 16 alignment system is only one of the many possible alignment systems that could be used, no limitation to the specific physical alignment system is implied. Using this alignment mechanism an installer can properly level a first panel 1, then connect the adjoining members 16, 17 to create aligning axes A and B without further measuring and leveling required as seen in FIG. 3.

Referring next to FIG. 5 panel 1 is fully loaded with hand/foot holds 60, 61, 62, 63, 64, 65. A number of possible designs hold are depicted, no limitation to the depicted designs should be implied, so long as the hold meeting the functional requirement discussed herein. Various angular orientations of each hand/foot hold are possible. The configuration of the hand/foot hold is designed to provide an easy to grab and hold support for the user. The holds are all at least laterally symmetrical along a transverse axis of the hold. The holds are not designed to be spaced more than 24 inches apart while in use with the disclosed method of exercising. The specific shape of each style of hand/foot hold is designed to engage different muscles on the user. The variety and close spacing of holds allow the user to rapidly and securely mount, move about and exercise, descend and dismount using a variety of hand/foot holds 60, 61, 62, 63, 64, 65 to create any desired type of exercise for the user. Aerobic and/or anaerobic, isolation, core, functional, work/occupational rehabilitation and other exercises are all possible using the disclosed system. Once a user is off the floor, the core muscles are engaged along with the limbs. Prior art climbing wall are significantly different in that they have small, widely spaced hand/foot holds. The large, easily gripped and closely spaced hand/foot holds of the present disclosure allow the user to move rapidly up and down or across the wall, allowing for cardiovascular workouts and a multitude of other types of exercises not possible on standard climbing wall. Other types of cardio exercise machines either support some or all of the body weight of the user or require the user to stand upright. A user climbing on the fitness wall 1 has to hold their body weight off the floor while exercising.

Figure 6:
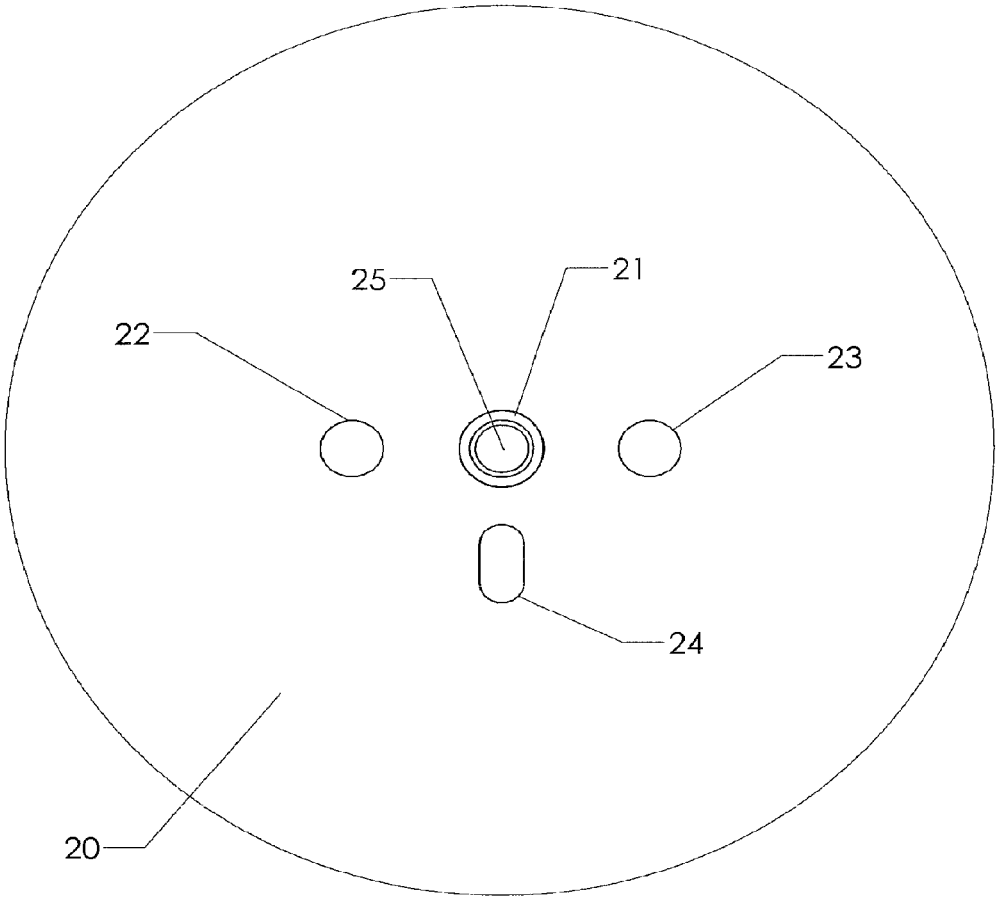
FIG. 6 is a front elevation view of a hole grouping.

In FIG. 6 each hole grouping 20 has a center bolt hole 25 with a threaded receptacle 21 and a keying slot or pin hole 24 functions as a second anchor to reduce the ability of climbing hold 60 to rotate even if the anchor bolt becomes loose. The threaded receptacle 21 is a separate piece that is mounted in hole 25 in the depicted embodiment. This allows the threaded receptacle 21 to be removed and replaced if the threads are damaged. Alternatively, threaded receptacle 21 can be formed into plate 2 and drilled out if damaged, but this is believed to be less desirable. Mounting holes 22, 23 can be used to attach a replacement threaded receptacle component (FIG. 10) if threaded receptacle 21 is damaged. The pattern of hole groupings 20 can be duplicated on different panels 2 allowing any two or more people located anywhere in the world to do the exact same exercises without variance. Or, if desired, each panel 2 in a set can have different pattern of hole groups 20 any combination thereof.

Figure 7:
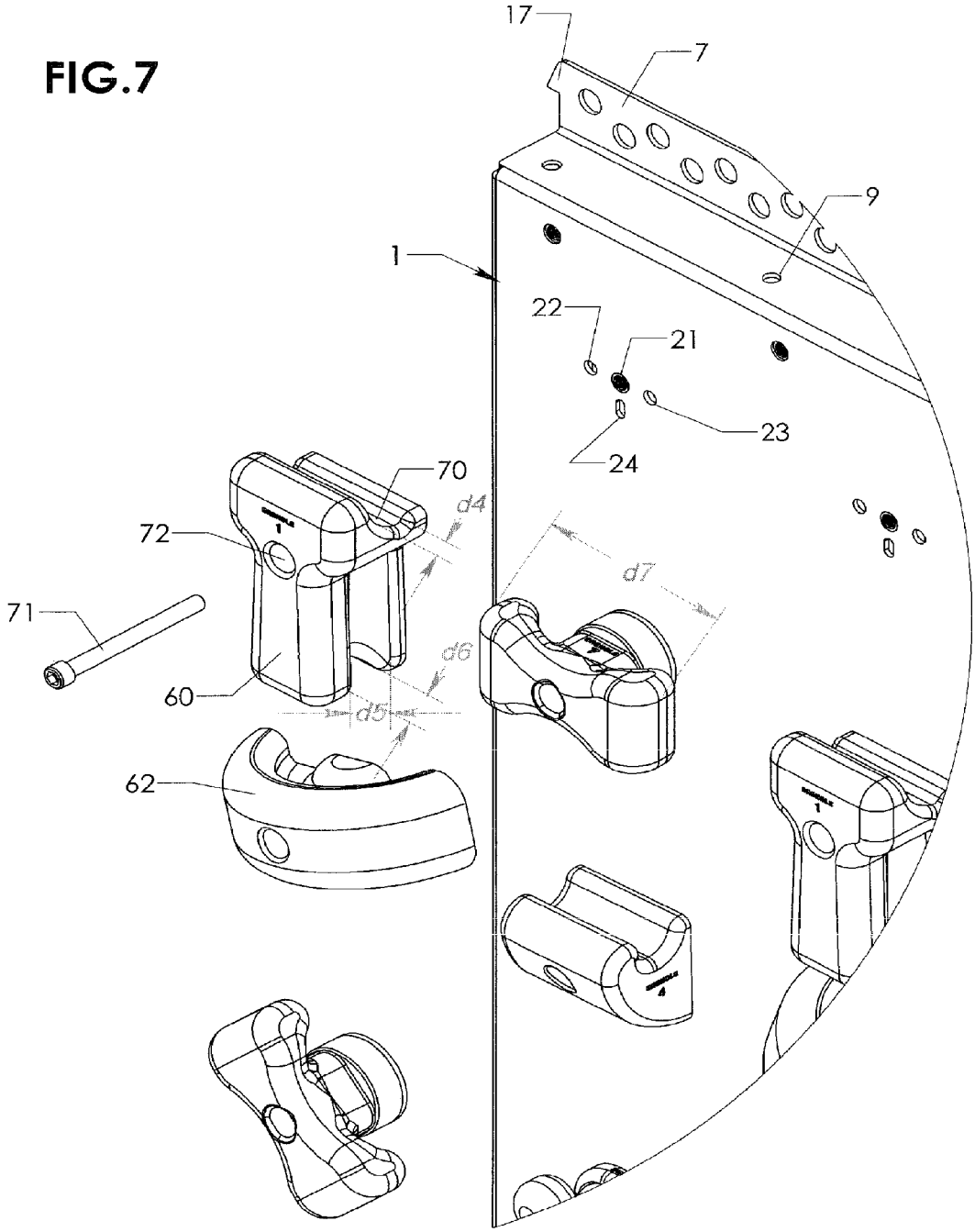
FIG. 7 is a partial exploded view of a wall segment and hand hold.
Figure 8A:
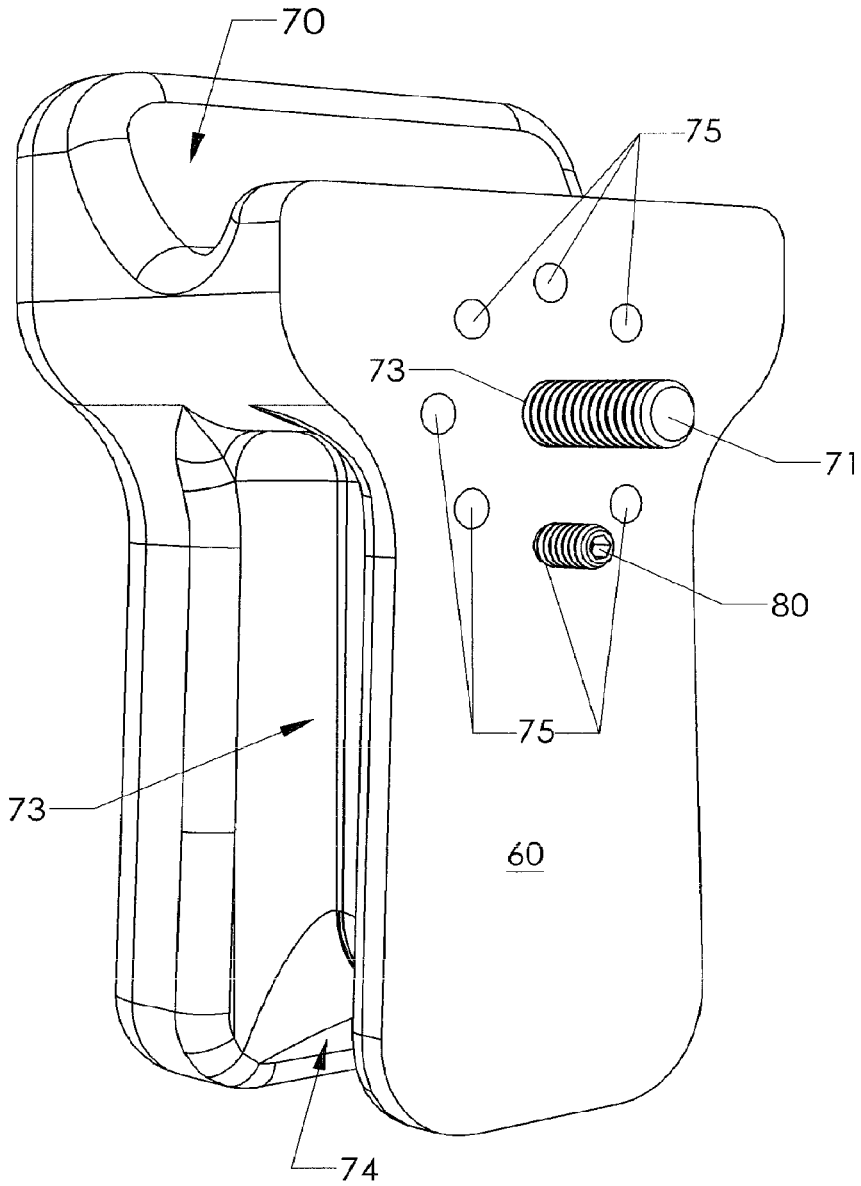
FIG. 8A is a rear perspective view of a hand hold.

Referring next to FIGS. 7, 8A-F hand hold 60 has grooves 70, 73 and 74 of sufficient dimension d4 for the fingers to grip with shapes specifically designed to engage targeted muscles and minimize finger and hand fatigue. Generally speaking, the holds are of sufficient size to allow a majority of the user's fingers to grip the hold at the same time. Hold 60 is depicted in FIGS. 7 and 8A and hold 62 is shown in FIGS. 8B-F. The discussion of mounting method and grooves applies to all disclosed holds, and any future hold design not depicted herein. The mounting method discussed below applies equally to all hand/foot holds uses with the disclosed system. The system is described in relation to a specific type embodiment 60 of the holds for the purposes of illustration only, no limitation to a specific type of hold is intended or should be inferred.

A mounting hole 72 which extends through the body of the hold 60 receives bolt 71, as seen in FIGS. 7 and 8A. Pin 80 inserts into one of keying holes 75, which are arrayed around hole 72, as seen in FIG. 8A-F. The pin 80 could be threaded, pounded in or molded into the body of the hold. In the depicted embodiment, keying holes 75 are threaded and pin 80 is threaded into selected hole 75 with a Alan wrench. The keying holes 75 can be slotted in line with hole 72 to accommodate any dimensional variance of holes 75 in relation to hole 72 caused by the manufacturing processes. Holes 75 allow for a number of orientations of each type of hold on the panel 1, as can be seen in FIGS. 8C-D and FIG. 5. Minimally one pin 80 inserted into one of holes 75 is required to lock the hand/foot hold in a static position and reduce the ability of the hold to spin during use.

Figure 9:
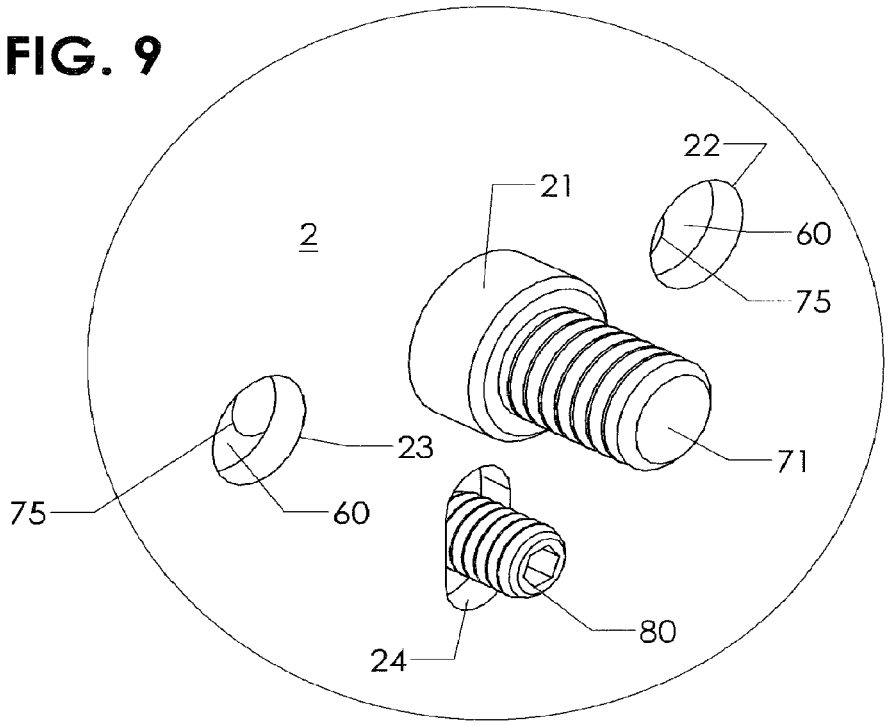

To mount the hold on the plate 2, bolt 71 threads into threaded receptacle 21 on hole 25 as see in FIG. 9. Pin 80 sets into keying slot 24. As seen in FIGS. 8C-D, the location of pin 80 in chosen hold 75 will determine the orientation of the hold on the plate 2. When hand/foot hold 60 is in the orientation shown in FIG. 7, groove 73 is of sufficient dimension d5 for fingers to get a vertical pinch grip that requires more and/or a different group of muscles to engage. Hand/foot hold 60 has groove 74 of sufficient dimension d6 to grip from underneath when an exercise requires the user to be puffing upward to maintain on the fitness wall. Each hand/foot hold has a central vertical axis with a left and a right side symmetric contour of the hold in the depicted embodiment. This provides the same grips for either a left or right hand user at the same time without changing the hand/foot hold or its position. Nominal dimension ranges are d4=0.5"-2", d5=0.5"-2", d6=0.5"-2". The height or width for holds in general is in the range of two to six inches for secure hand/foot holds in the depicted embodiment. Hand/foot holds can be made of, but not limited to, various materials strong enough to produce adequate strength that are cast, machined or formed into specific shapes for differing exercise requirements and options. In the depicted embodiment, the holds are made of metal.

Figure 10A:
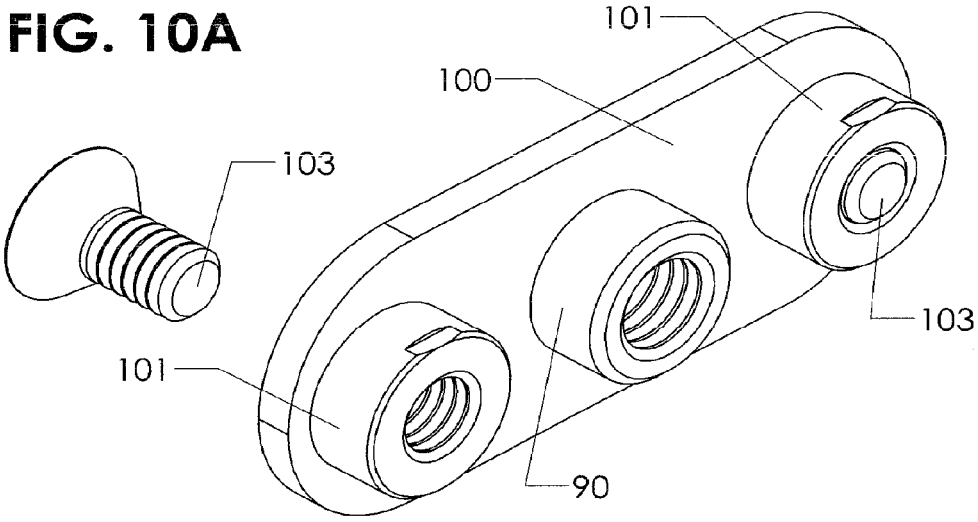
FIG. 10A is a rear perspective view of a replacement threaded receptacle.
Figure 10B:
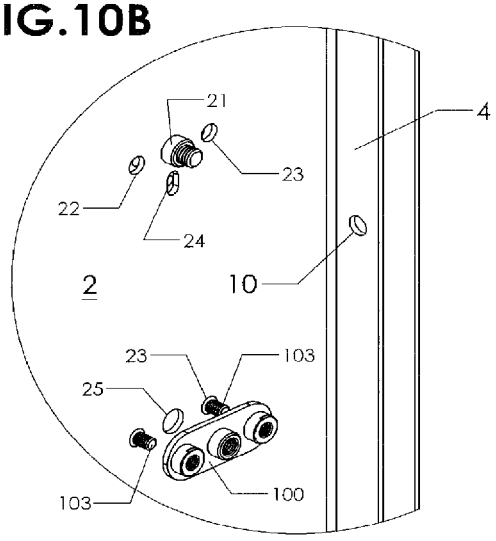
FIG. 10B is a rear perspective view of a replacement threaded receptacle exploded away from wall.
Figure 10C:
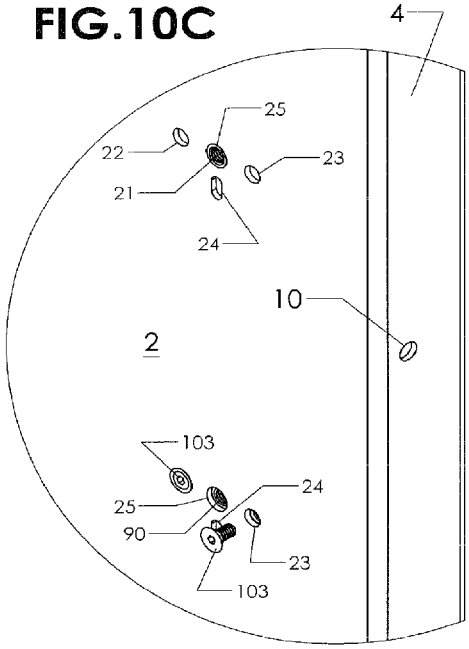
FIG. 10C is a front perspective view of a replacement threaded receptacle attached to wall.
Figure 10D:
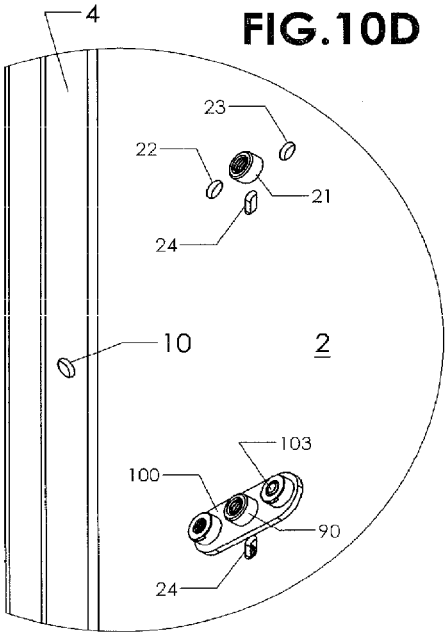
FIG. 10D is a rear perspective view of a replacement threaded receptacle attached to wall.

Referring next to FIG. 9 a single hole grouping 20 is shown from the rear of plate 2. Bolt 71 has been threaded into threaded receptacle 21 and pin 80 slots into hole 24 to reduce the ability of the hold to rotate, even if bolt 71 has loosened with use. The threaded receptacle is compressed into the panel 2 and may be done in such a manner that it can be removed and then replaced if desired or required. The threaded receptacle can be welded or fused into place. If the inserted threaded receptacle 21 is damaged then it can be broken away due to its breakaway design. If welded or fused it can be cut away without damage to the panel. The damaged threaded receptacle 21 can be replaced with the replacement component having a plate 100 that has a replacement threaded receptacle 90, as seen in FIGS. 10A-D. FIG. 10B is a perspective view of plate 100 being placed on plate 2 after threaded receptacle 21 has been removed from hole 25. FIG. 10C shows the bolts 103 being placed in holes 23. FIG. 10D is a perspective view of the plate 100 mounted on the plate 2. The rear panel 100 is mounted to panel 1 bolts 103 through holes 22, 23 with threaded receptacles 101. This replacement method maintains the original anchor point center bolt hole 21 without having to move its location or weakening the structural integrity of panel 2 and therefore having no future affect on exercises, patterns, sequences and anything else that would have to be changed as a result of changing the anchor point location.

Figure 11:
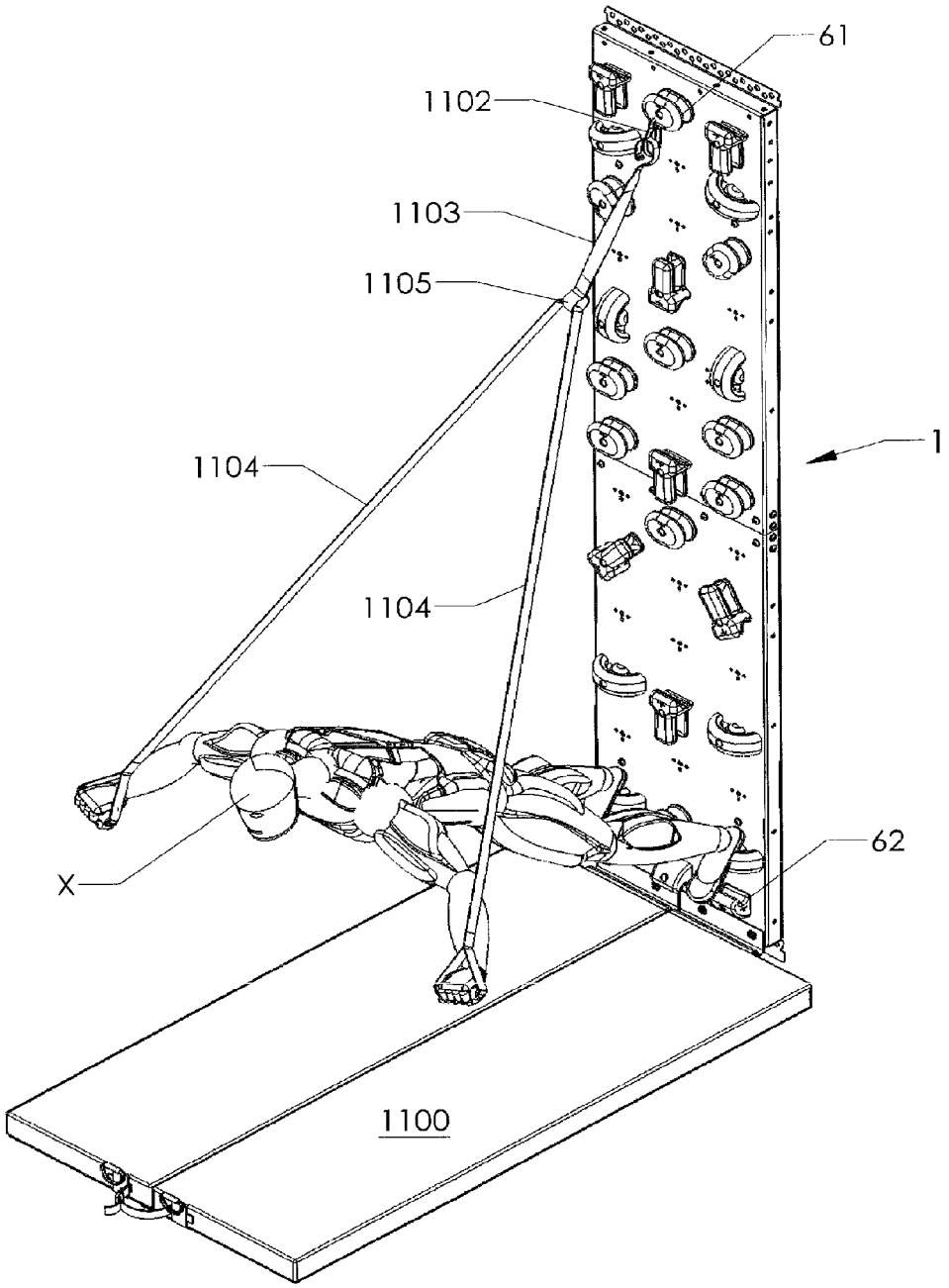
FIG. 11 is a top perspective view of a wall segment with an elastic strap.

Referring next to FIG. 11 the panel 1 has a hand hold 61 at the top used to secure a mounting strap 1103 having an end with a carabineer 1102 that is looped around and connect back to itself creating a loop in which to go over and around said hand hold securing itself in place. A harness loop 1105 supports a strap 1104 so that user X can perform a variety of exercises, including supporting the toes above the ground or a mat 1100 on foot holds 62 as shown. Strap 1104 can be elastic in some or all of its length to allow for resistance exercises to be preformed.

Figure 12:
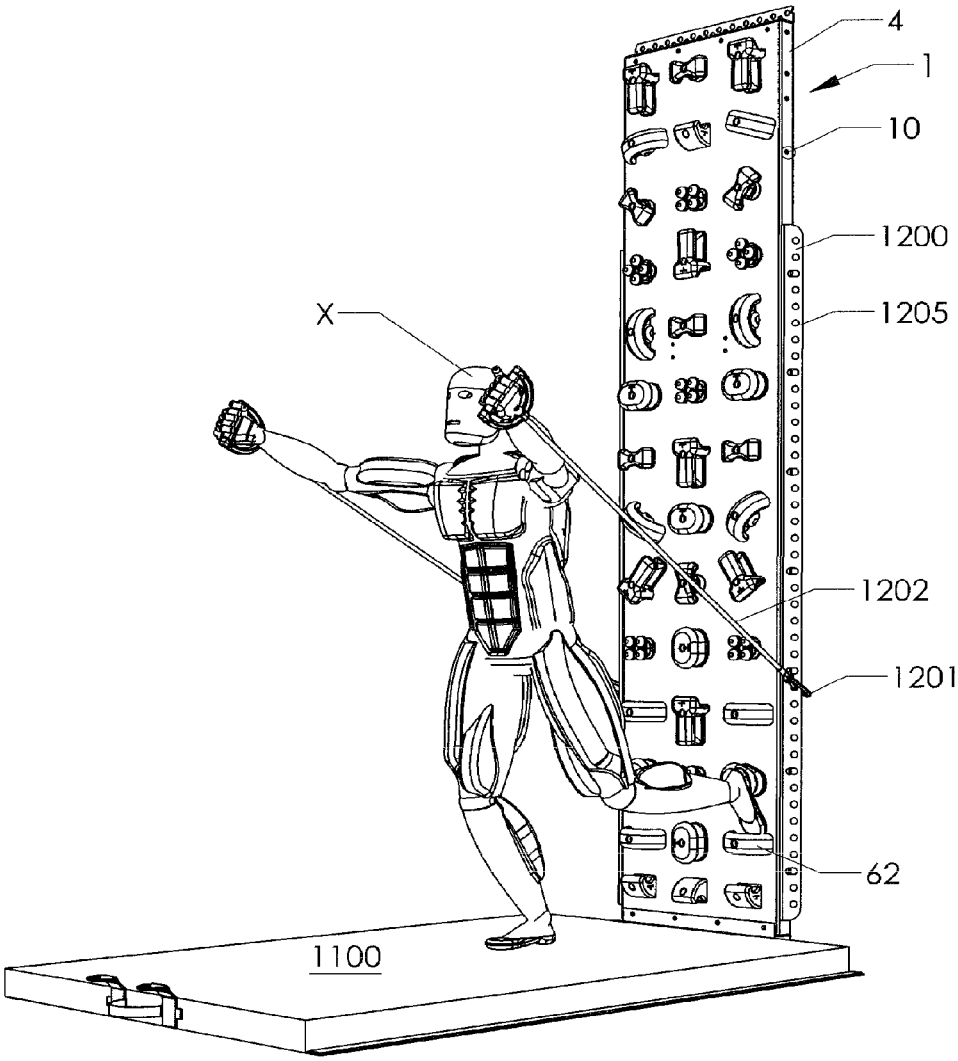
FIG. 12 is a front perspective view of a wall segment with a pair of side mounted straps.

Referring next to FIG. 12, a side bracket (which can be thought of as being a mounting bracket) 1200 having holes 1205 is bolted via holes 10 to flange 4. Holes 1205 can support a carabineer 1201 and elastic member 1202, such as strap, band or tube so that user X can exercise as desired allowing a multitude of anchor point locations. Although an elastic member 1202 is shown in the depicted embodiment, the system can incorporate features shown and described in reference to FIG. 13 and in particular the system can use using a non-elastic strap, webbing, rope chain or cable with the same advantages.

Figure 13:
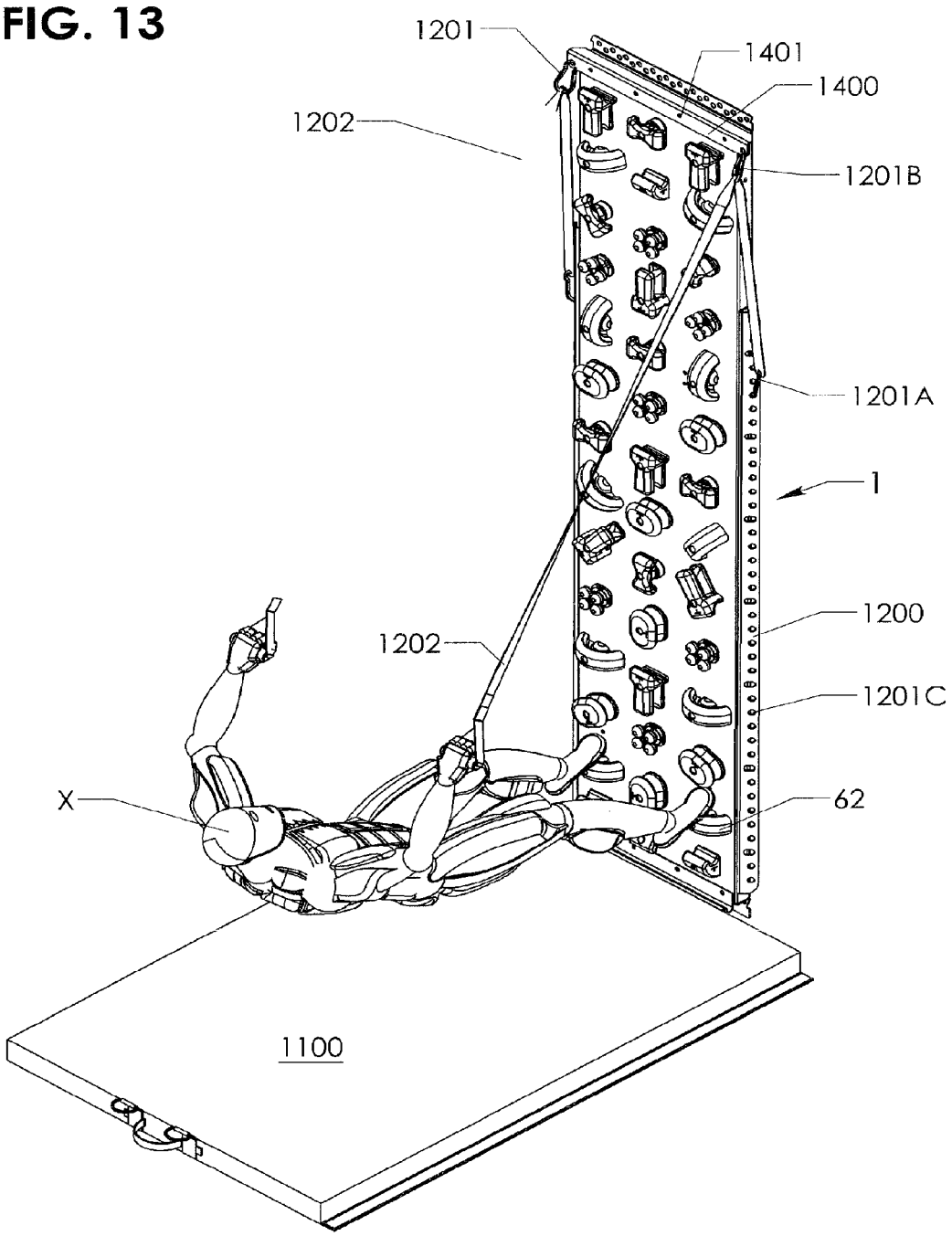
FIG. 13 is a front perspective view of the wall segment with a pair of top and side mounted straps.

Referring next to FIG. 13 a non-elastic strap 1202 made of, but not limited to, webbing, rope, chain or cable can be fed through carabineer 1201A through carabineer 1201B which is attached to side bracket 1200 to allow user to pull down, up, forward or back on straps 1202 to move the user's body against gravity. An optional top bracket 1400 can be used to create a single level of anchor point along the top of the panel 1 which is attached with bolts through holes 1401 into holes 10 or panel 1 to support carabineer 1201B. Each strap 1202 can be attached to different and independent anchor points at each side of the panel 1 to the side bracket 1200 or top bracket 1400. This allows the user to use just one strap 1202 without the second strap 1202 having any effect on the length or position of the other strap or becoming entangled when it is not in use. The anchor points of 1201A, 1201B can be moved up and down the vertical length of the panel 1 on 1200 to change the leverage and gravitational forces on the user. The pivoting anchor point of the two different straps 1202 can be anchored at differing heights on 1200 to create more dynamic forces and training methods. Since the straps are anchored and maintained at a given distance apart on the panel 1, the pivoting points of the strap at the anchor points are similar the pivot points of a person's arms in to their shoulders and help create rotational stability for the user. As the straps do not come together at a single point, the motion of the straps is similar to the motion of the user's body. The length of the straps 1202 can be adjusted to fit the height of the user, conforming to the need of an exercise and selected anchor points. The user can move their feet up and down the panel 1 on or between the hand/foot holds 61, 62, 63, 64 and 65 to change the exercise.

Figure 14:
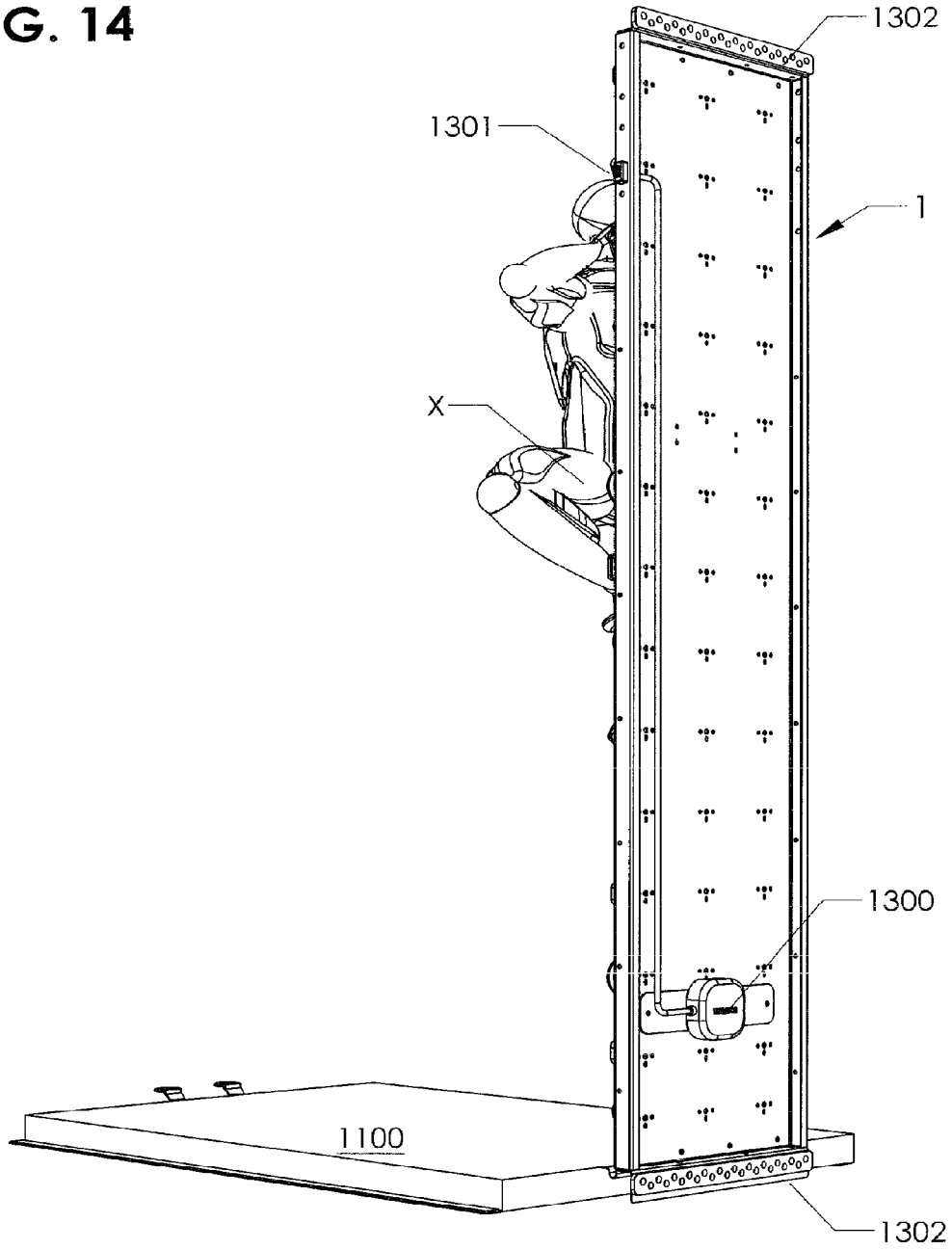
FIG. 14 is a rear perspective view of the wall segment with a vibration producing device.

FIG. 14 is a rear perspective view of the panel 1 with a vibrating mechanism 1300 having a switch 130 placed up high to challenge the user X physically to reach it and turn it on while user X is holding onto the fitness wall and off the floor. A switch can be placed anywhere or remotely controlled or activated by the user's weight or touch on the wall or holds. The vibrating mechanism 1300 stimulates the muscles of user X by vibrating the entire panel 1 and all the hand holds along with everything that may be attached to it. The vibration can be done by repetitively moving the panel 1 horizontally, vertically, angled, circular or a combination of any or all. Sonic and sound vibration can be produced by attaching sufficient speaker devices behind the wall to transfer the sound vibrations or even music through the wall to the hand holds. This would cause the vibration of the wall and attachments to vary according to the beat and tempo of the music changing the physical affect on user X as the music changes in intensity and tempo, thereby using music and song to produce a vibration element to the exercise. Spacers 1302 can be added between flanges 7 and 8 and the wall to dampen the vibrations transferring to the wall and allow the panel 1 to vibrate and move independent of the wall it is attached to. Spacer can be used between the floor and a support frame made to attach panel 1 instead of a wall to dampen the vibration transfer to the floor. The spacers can be made of, but not limited to, springs or pliable material such as rubber or urethane.

Figure 15:
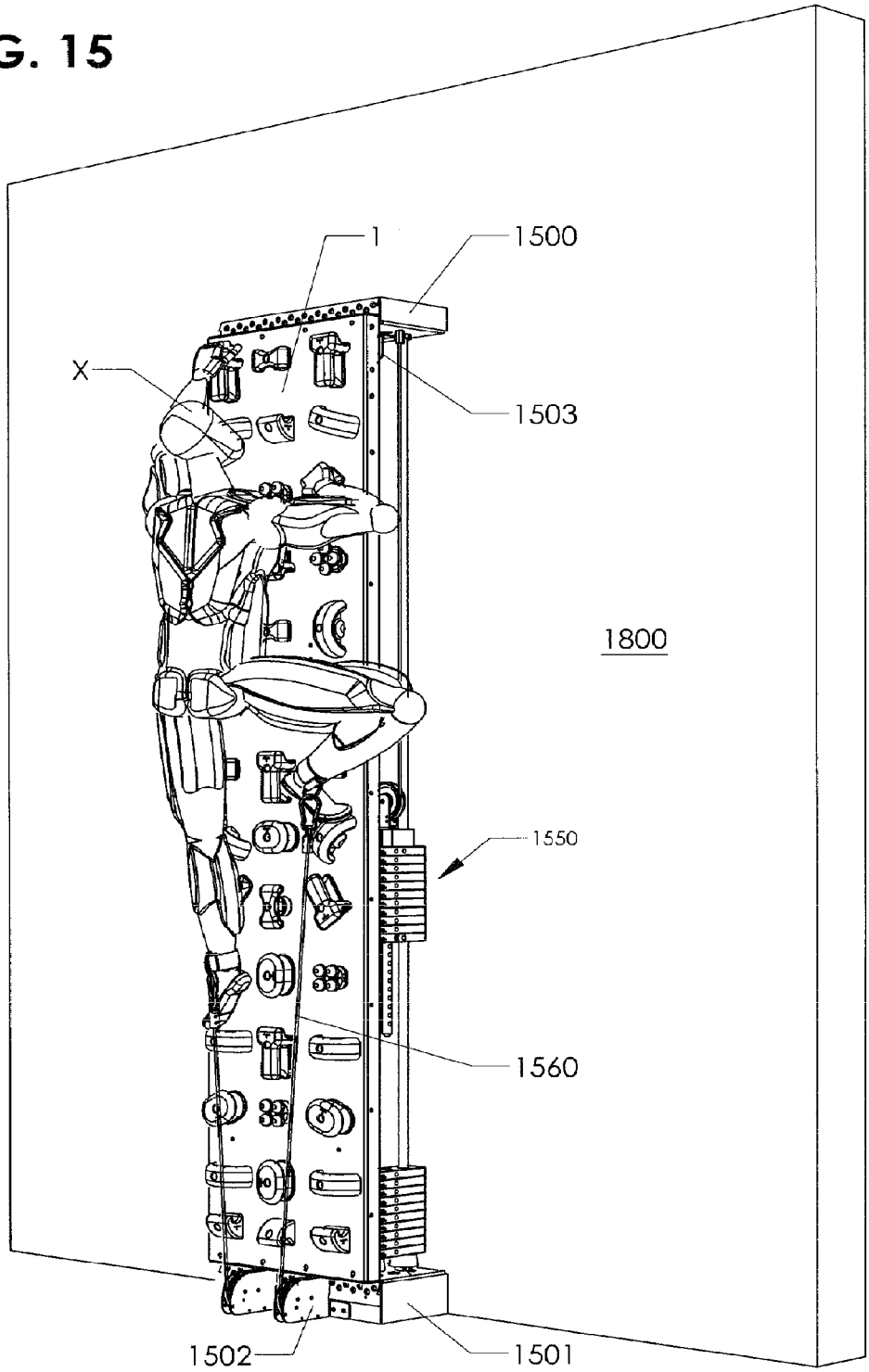
FIG. 15 is a front perspective view of a wall segment with pulleys and weights.
Figure 16:
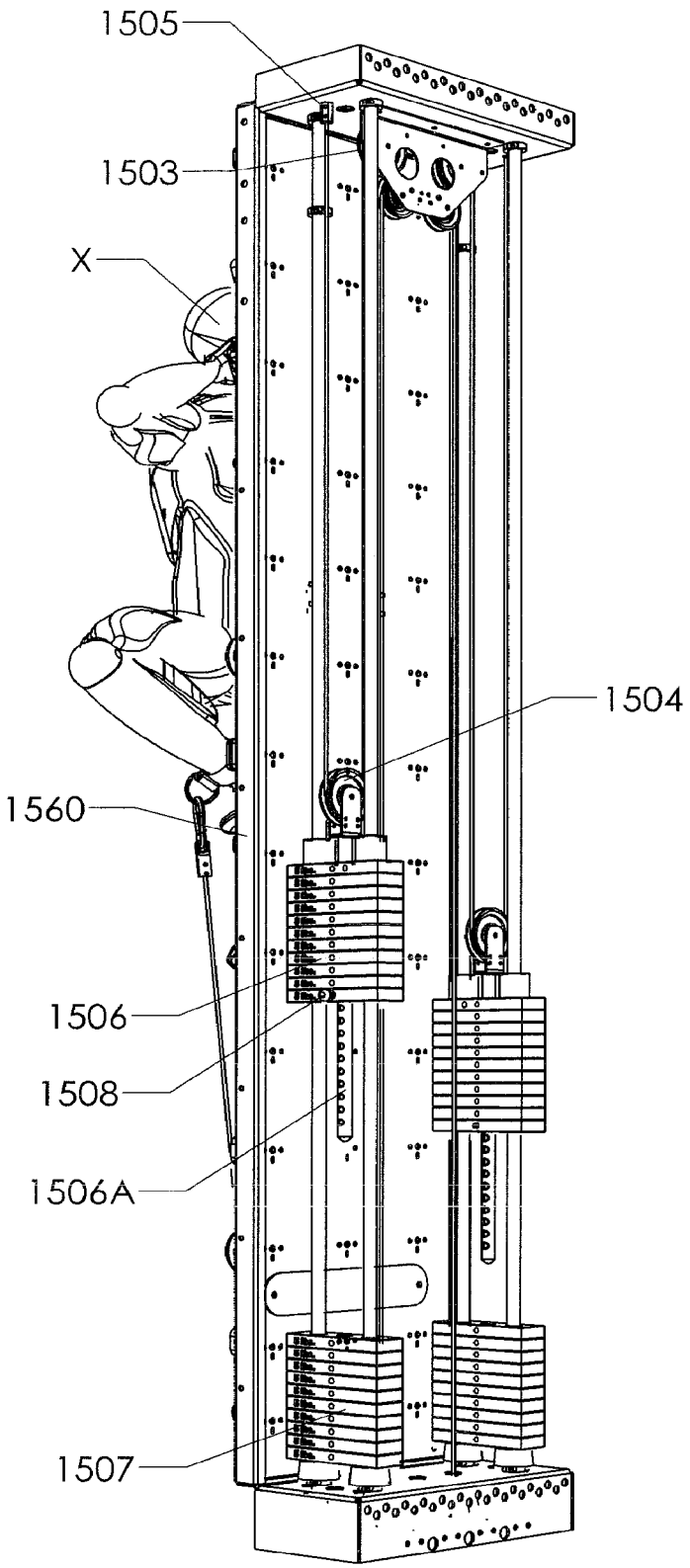
FIG. 16 is a rear perspective view of the FIG. 15 embodiment.

Referring next to FIGS. 15, 16 setoffs 1500, 1501 support panel 1 away from wall 1800 to allow a pulley system 1550 to produce an adjustable downward force on user X. Setoffs 1500, 1501 can be made in such a manner as to support each other and the panel 1 if attached to the floor instead of a wall. Cable 1560 hooks to the user's body at the ankle, waist or wrist then through base pulley 1502 then through top loop 1503 then through platform pulley 1504 and finally to anchor 1505. The pulley 1502 can be positioned on the sides of the panel or arms (not shown) that may extend outward from the sides of panel 1 to create up, outward, downward, or combination thereof, resistance to the user while holding on to or exercising on the fitness wall panel 1 or any attachments that may be fixed to the panel 1. A multitude of pulleys can be attached at the bottom and sides and top to create varying points of resistance while exercising that can be combined or used individually. A combination of attachments from more than one resistance point can connected to the wrists or ankles or waist or all can be hooked to the user X to produce varying types of shifting resistance to user X while exercising and moving about the fitness wall. Handles can be attached to the ends of the cables and used for a multitude of other exercise and training methods.

The variable weight pile 1506 is lifted from the weight stack 1507 using a pin 1508 through a center shaft running through the weight stack with a series of holed along it that will engage a desired amount of resistance during use. Pulley system 1550 can have a left and a duplicate right system independent from each other as shown. The weight stack 1507 can be replaced with an electric resistance motor or brake or other known in the art resistance systems. More than two weight stacks and cable systems can be incorporated.

Figure 17:
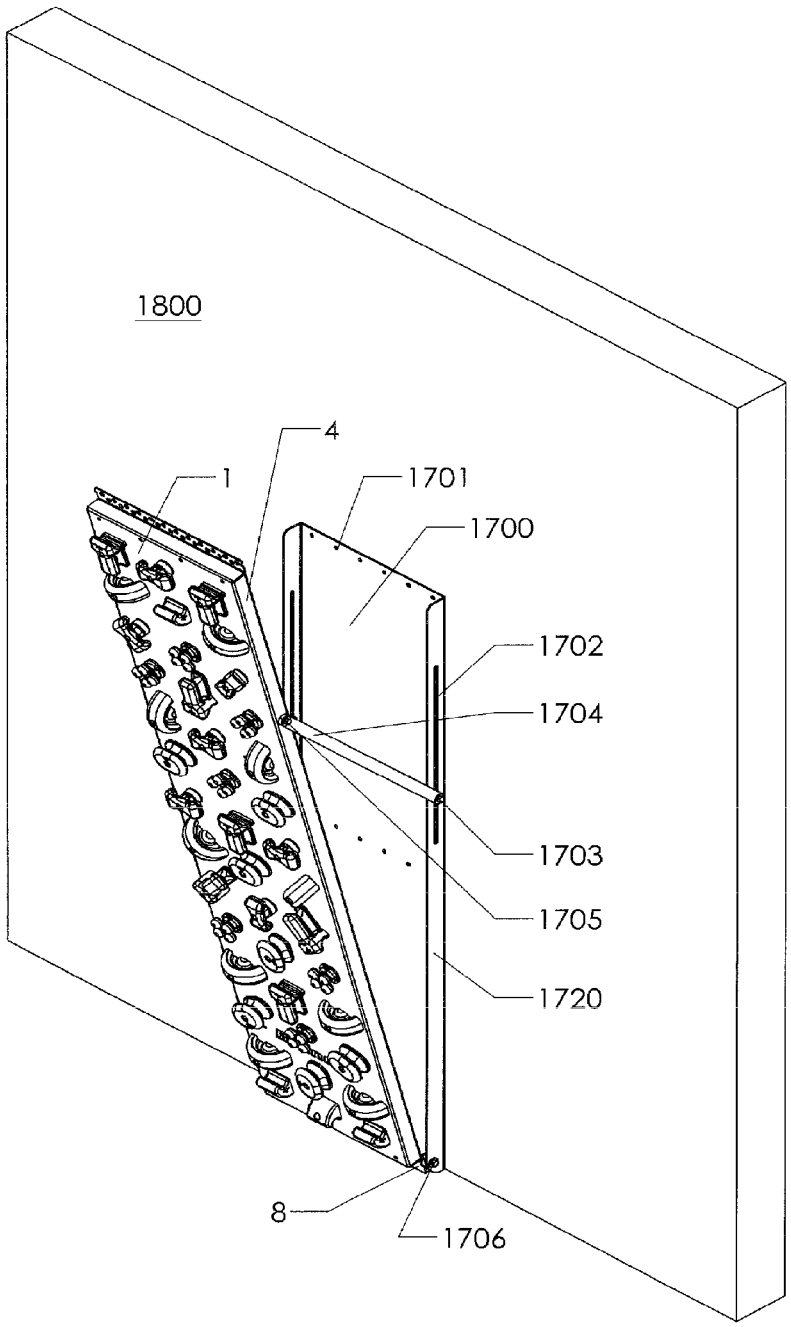
FIG. 17 is a front perspective view of a tilt embodiment.

Referring next to FIG. 17 a panel 1 is mounted to a tilt brace 1700 which has side flanges 1720 each with a slot 1702. Fastener 1703 is slidingly mounted in slot 1702 and pivotally attached to arm 1704. Arm 1704 is bolted at bolt 1705 to flange 4 of panel 1. Pivot 1 fastener 1706 secures bottom flange 8. Panel 1 as shown has an overhang that making exercise more difficult. Retracting arms 1704 vertically puts panel 1 flat against wall 1800. The assembly can be done in such a manner as to allow the both the bottom and the top to come away from the supporting structure at a given horizontal axis that can be located at any level on or above the floor. This will allow the panel 1 to be set at any positive or negative angle for any desired change in exercise dynamics and intensity. If desired two sets of arms 1704 can be used to allow further adjustability. The angle of the panel 1 can be changed by motors or automation set manually or by a predetermined program changing in intervals or randomly as desired.

Figure 18:
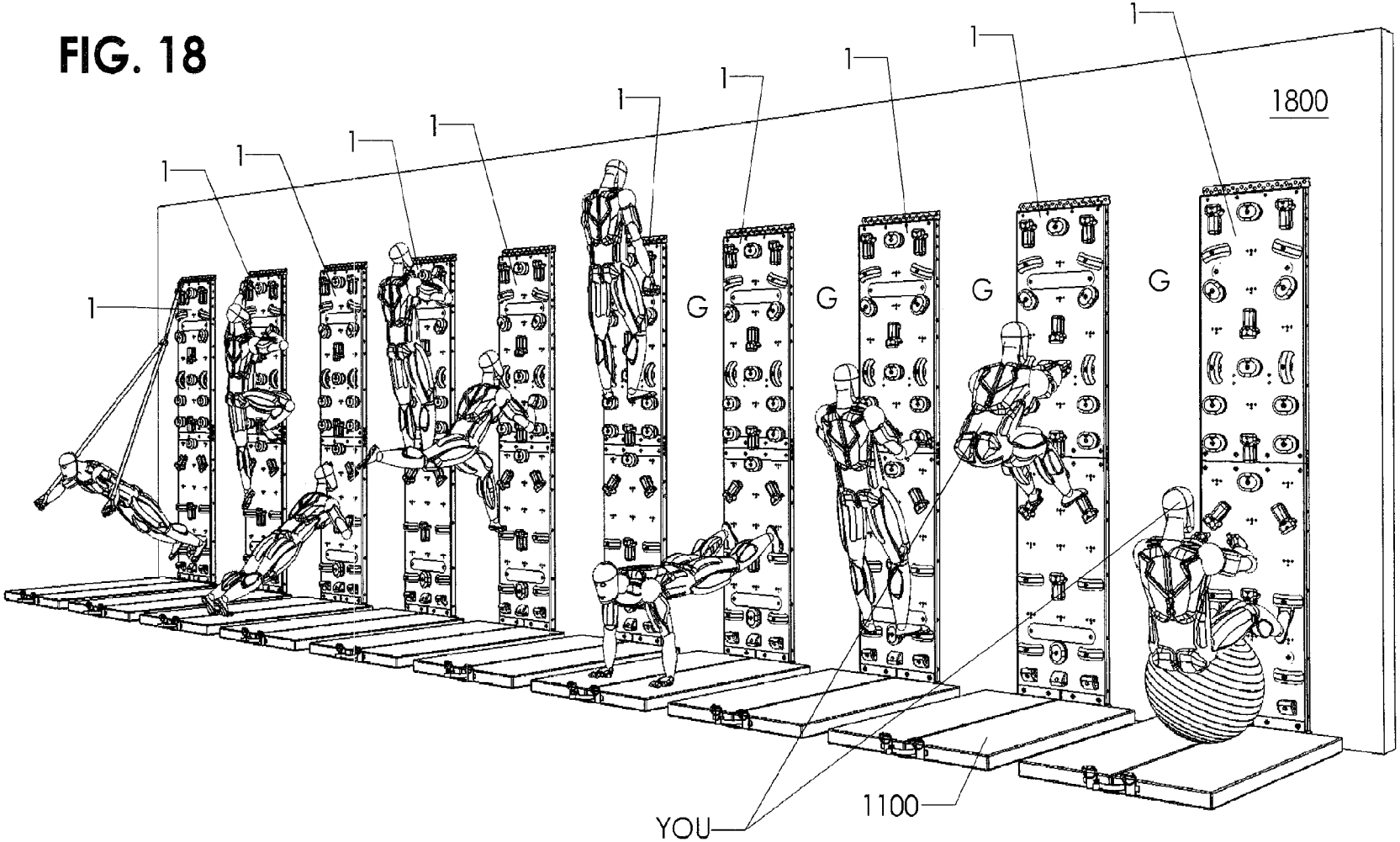
FIG. 18 is a front perspective view of a gym with spaced apart wall segments.

FIG. 18 shows an exercise gym layout with a gap G between panels 1. Ten users X are doing various full body and isolation workouts of different methods in a limited space against wall 1800.

Figure 19:
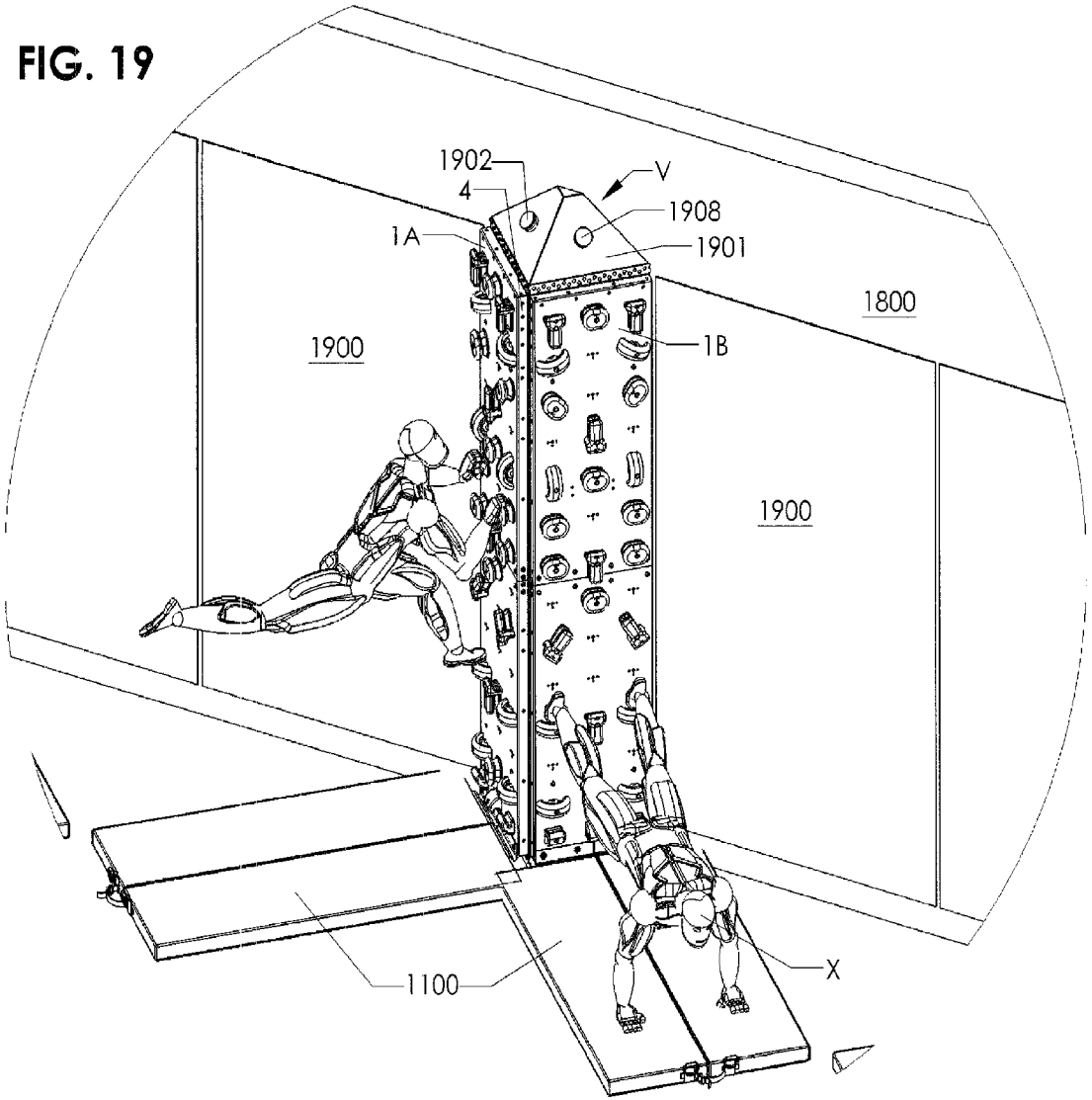
FIG. 19 is a front perspective view of a dual projected embodiment.

FIG. 19 shows an L bracket (not shown) to the eye joining flanges 7 and 8 of panels 1A, 1B at a 90 degree angle in the depicted embodiment Other angles are possible. This form V projection from wall 1800 allows users X to work out on individual panels 1A, 1B or move and exercise back and forth. The V configuration also allows user to see themselves on mirrors 1900 that can be placed on either or both sides of the V projection. Mirrors can be used to allow users to see and maintain proper exercise form and extension. A top cover 1901 can be attached to enclose the top opening and be used to support buttons and/or lights 1908. A push button 1902 can turn on and off sound and/or light to mark the user reaching the top. or to count how many times he reaches the top of performs an exercise moment or series of movements This can especially be a great motivator for the young. The button 1902 can also be the light source.

Figure 20:
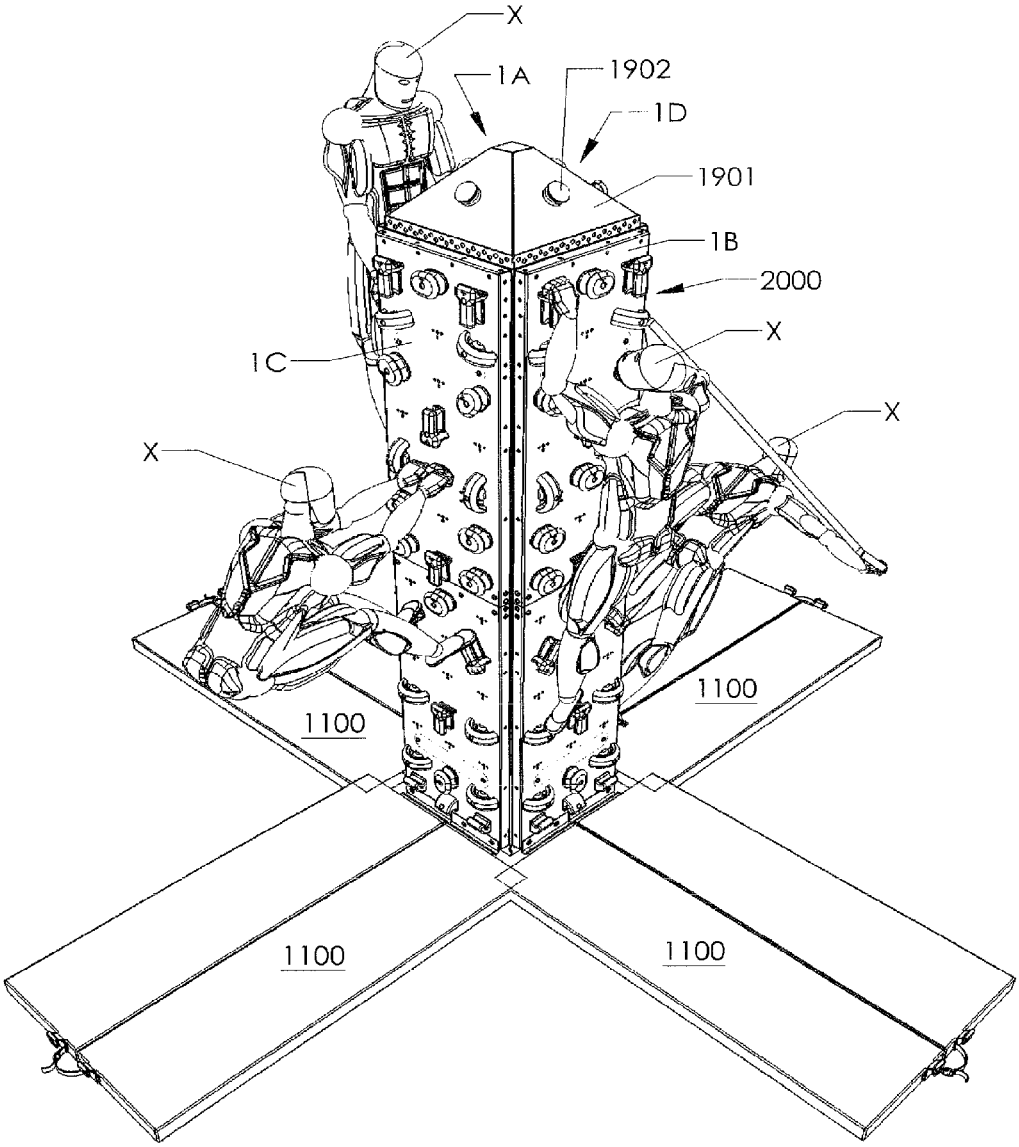
FIG. 20 is a front perspective view of a tower embodiment.

Referring next to FIG. 20 an exercise tower 2000 is formed by joining panels 1A, 1B, 1C, 1D into a square along their flanges 7 and 8.

Figure 21:
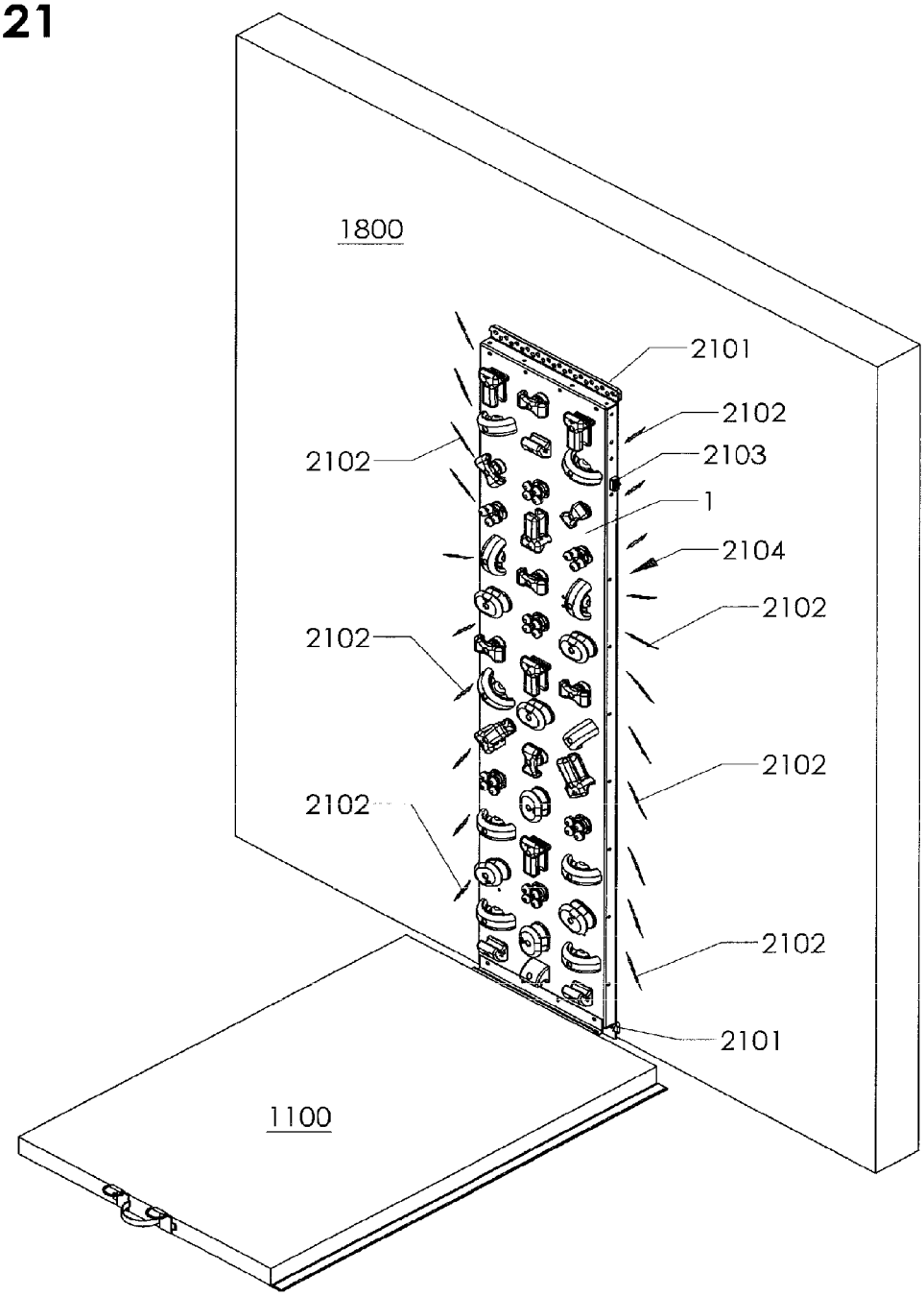
FIG. 21 is a front perspective view of a lighted fitness wall.

FIG. 21 shows a panel 1 with a spacer 2101 between flanges 7 and 8 and the wall to allow a light source to be mounted behind and/or on panel 1 for rays of light 2102 to illuminate outward from the sides and any empty holes or decorative holes to create a different and inspiring atmosphere. Said lights can be made to change in color or intensity as a given duration of time expires acting as an incentive or timer.

Figure 22:
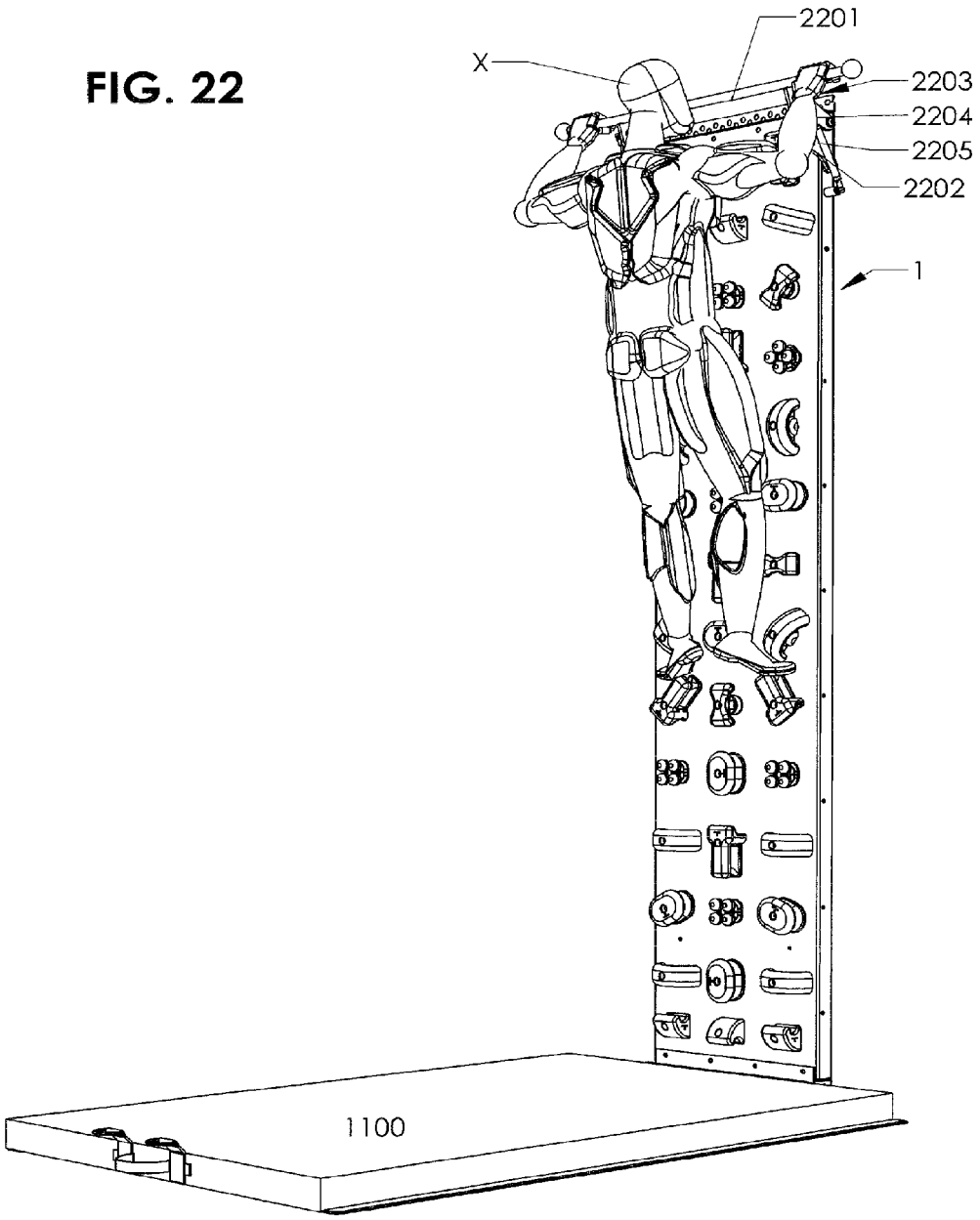
FIG. 22 is a front perspective view of a bar accessory.
Figure 23:
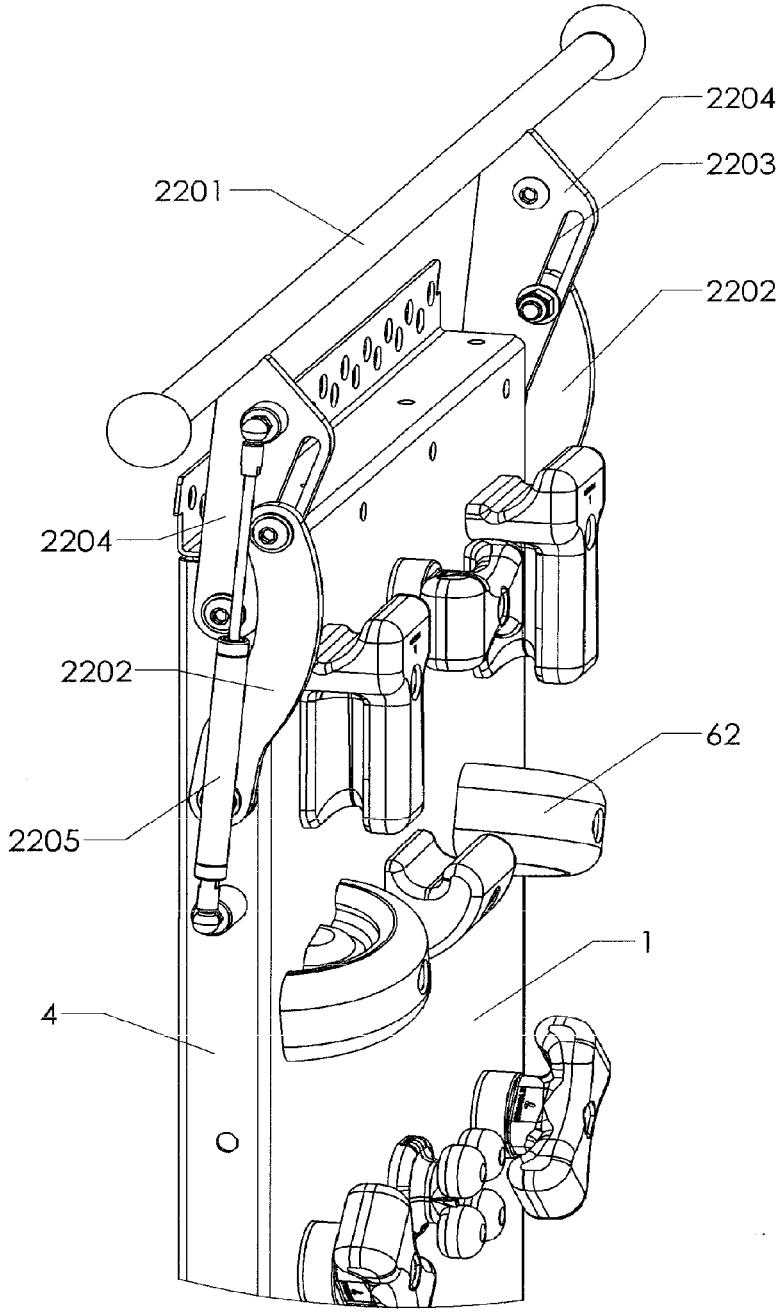
FIG. 23 is a perspective view of the bar accessory in a folded position.
Figure 24:
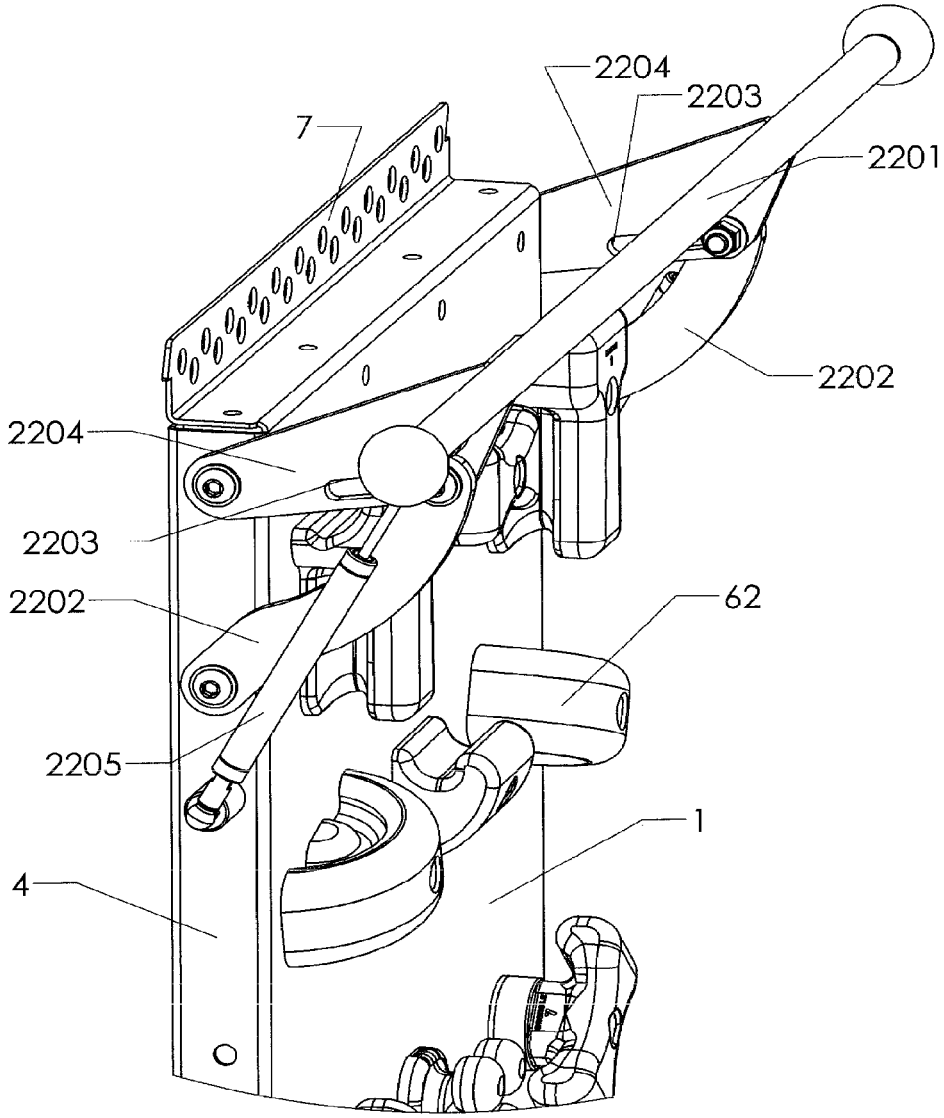
FIG. 24 is a top perspective of the bar accessory in an extended position.

In FIGS. 22, 23 and 24 a horizontal bar 2201 is attached at the top of the panel to allow varying grips of puffing exercises to be done such as, but not limited to, a conventional style pull-up with the ability for user X to assist himself when the user's weight becomes to much to continue the exercise properly with just the muscle targeted. The horizontal bar 2201 can be affixed in a stationary position or made to adjust and retract from a usable position into a neutral position out of the way. A sliding arm 2202 is pivotaly attached flange 4 and is slideably mounted in slotted hole 2203 in a side plate 2204 to allow the bar 2201 to be moved from an upright and neutral position down into a usable position. A spring or pneumatic cylinder 2205 is pivotable attached to side plate 2204 and to flange 4 to bias and hold the bar up 2201 and in the neutral position in the depicted embodiment. The bar 2201 can be locked in either the neutral or working position with a pin or latch (not shown).

Referring next to FIG. 23 the horizontal bar 2201 is in the upright position out of the way of user X. In the depicted embodiment the bar 2202 is biased to a neutral non-use storage position when there is no downward force to pull and hold it down in the working position against the force of springs or shocks 2205.

In FIG. 24 the horizontal bar 2201 is in the working position allowing user X to use it for exercises or attaching other things to it for a multitude of other exercise methods. The system could also be mounted on brackets (not shown) to allow the folding bar mechanism to be attached to a normal wall, above a door or other locations that a folding exercise bar may be desired.

Figure 25:
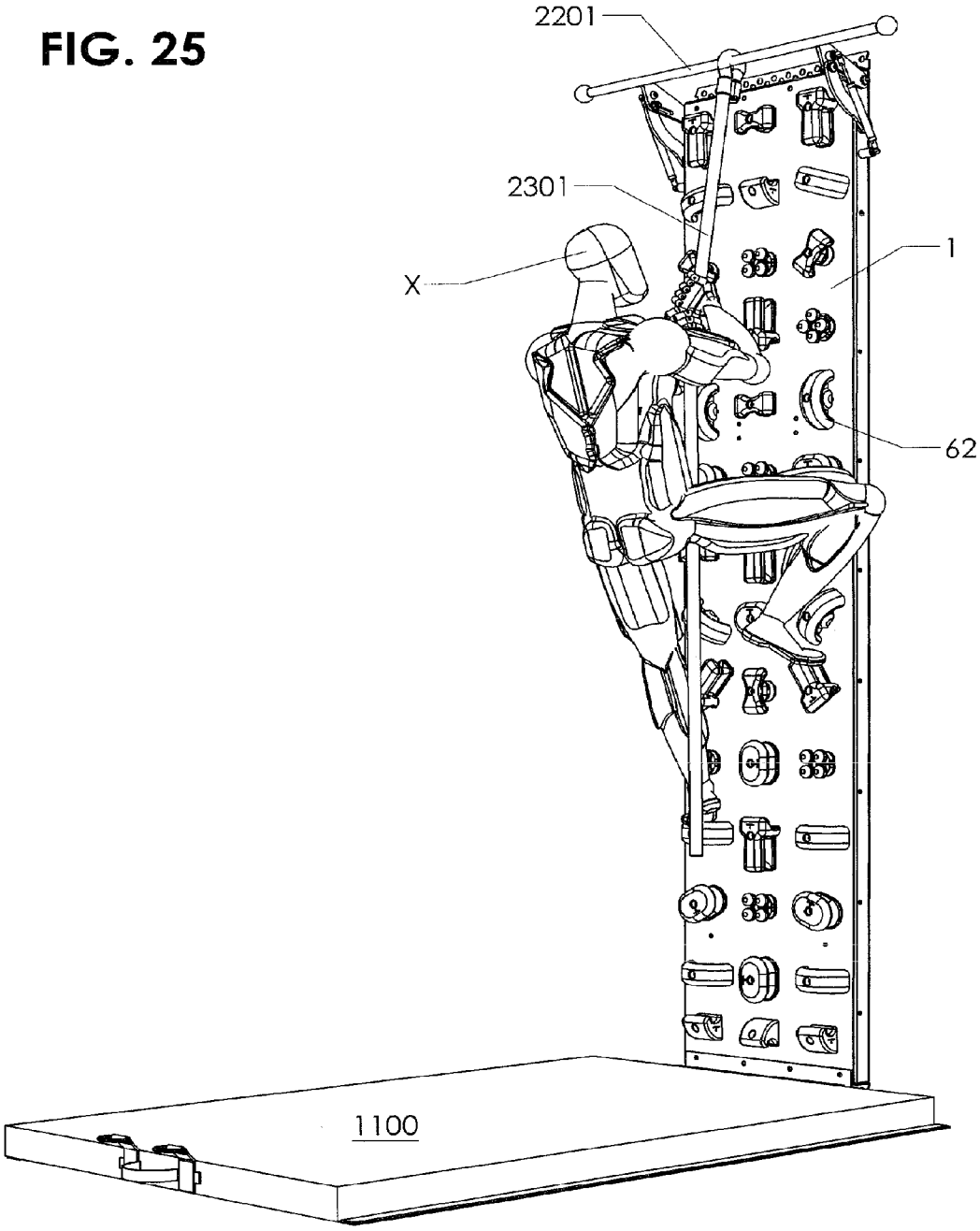
FIG. 25 is a front perspective view of a rope attachment.

A rope 2301 of any length can be attached to the top of the panel or horizontal bar 2201 or any other point and level on the panel 1 to force user X to use only user's feet to stabilize user X on the fitness wall, as shown in FIG. 25. This forces user X to use a different series of muscles to hold onto while puffing on the flexible and non stationary rope to remain centered on the fitness wall while ascending, descending, moving side to side and doing exercises as opposed to using stationary hand holds or attachments. The grip on the rope is positive and sure, but not stationary like that of a bolted on rigid hold or handle.

Figure 26:
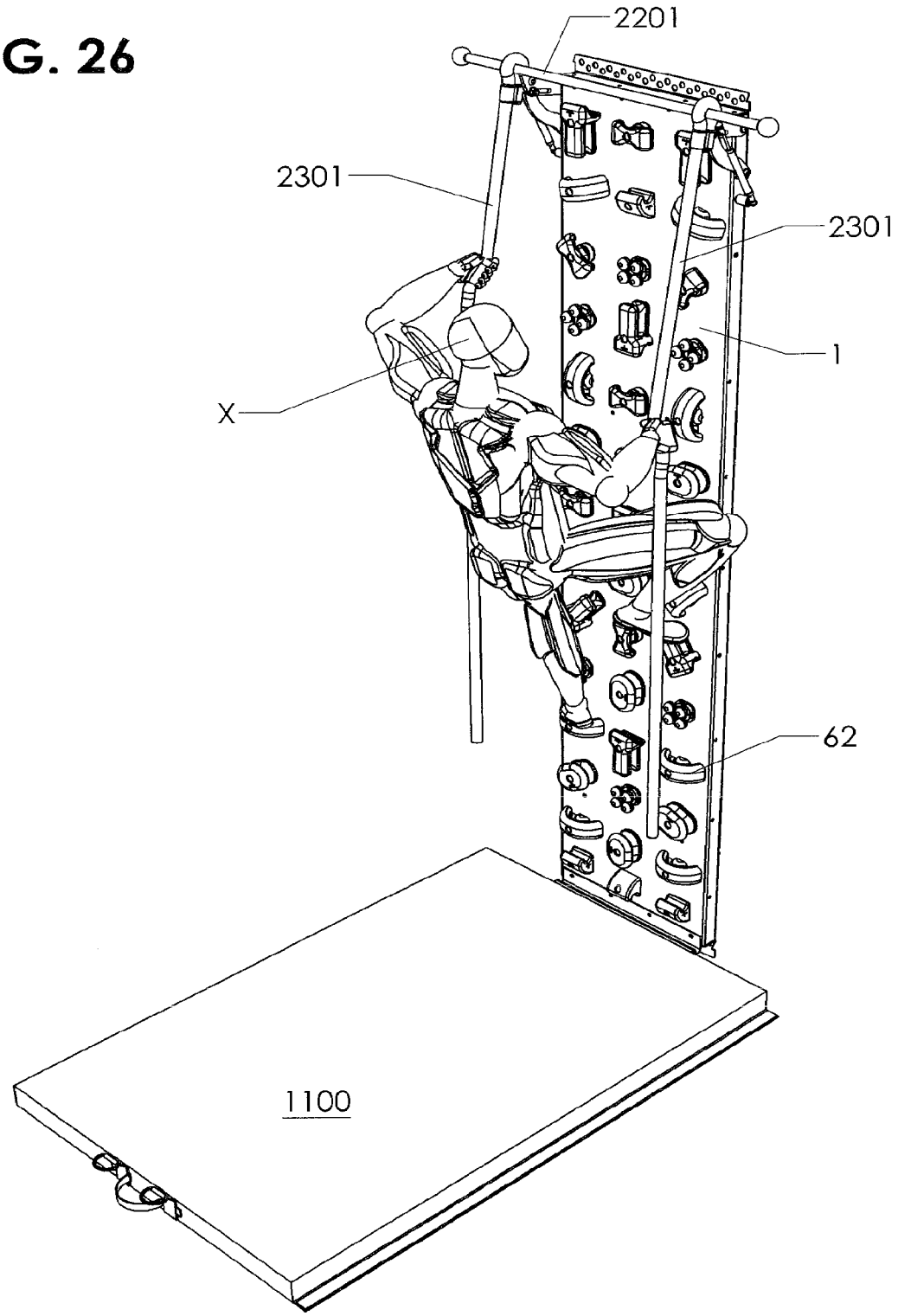
FIG. 26 is a top perspective view of a multi-rope attachment.

Referring next to FIG. 26 more than one rope 2301 is attached to the top of the panel or horizontal bar 2201 or any other point and level on the panel 1. More than one rope will force more concentration and a different series of muscles to coordinate the separate hold user X has on two different ropes. Letting go of one rope to reposition user's X hand on a different rope causes user's X body to naturally shift to the side that user X is holding on to the rope and pulling user's X body off center to the fitness wall. It will take more and different abdominal muscles to keep from swinging uncontrollably to one side and off the fitness wall.

Figure 27:
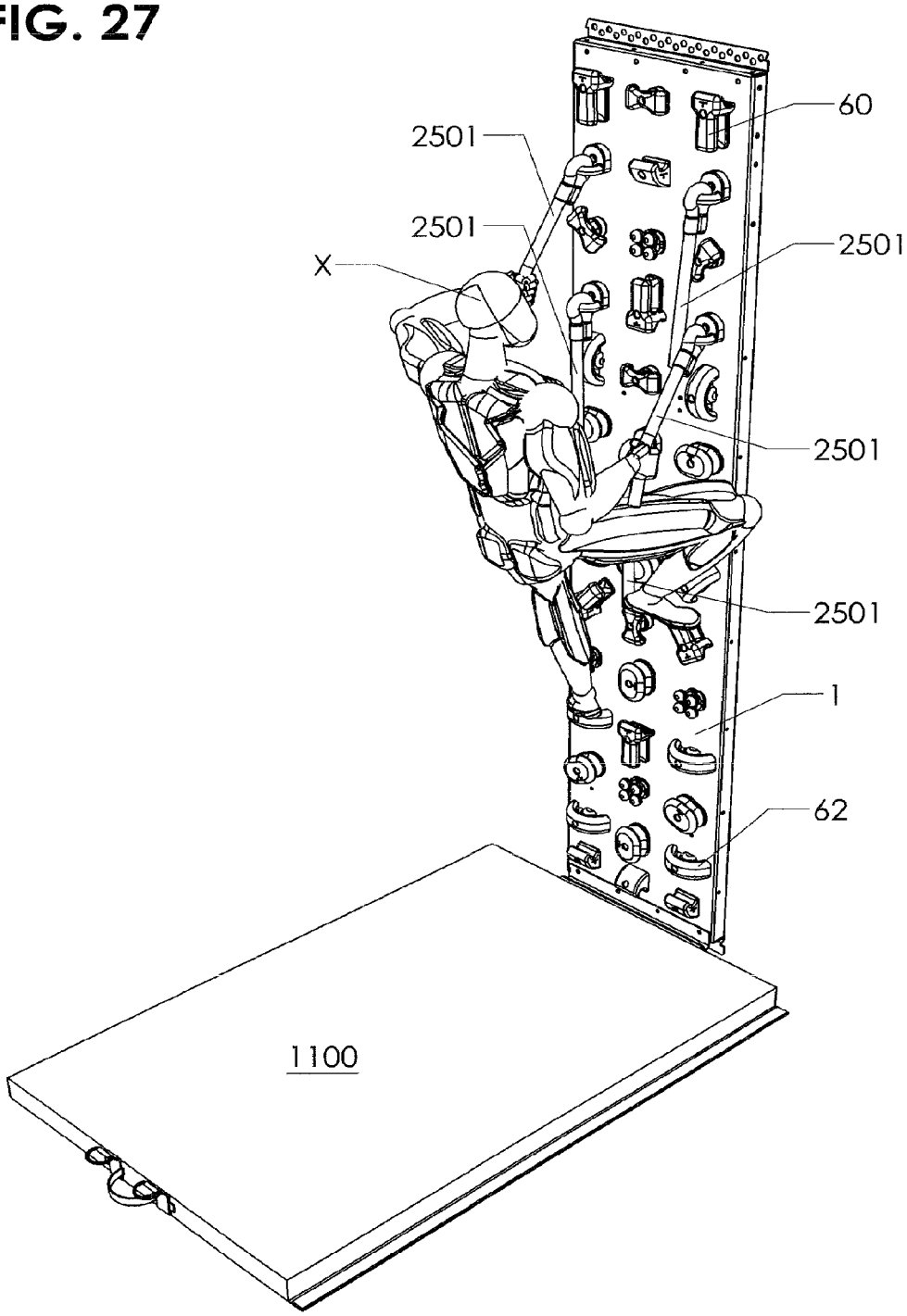
FIG. 27 is a top perspective view of a short rope attachment.

A single or multitude of short rope lengths 2501 can be attached to the panel in varying locations in substitution of stationary holds, as seen in FIG. 27. This allows a slightly more controlled hold than a long rope attached to the top of the panel allowing the user to rotate the hand in more stressful positions while maintaining a positive and firm grip. The short rope lengths 2501 can be use by themselves on that panel 1 without any other holds or attachments required to create an innovative exercise challenge. A series of rope lengths 2501 can be done on a series of adjoining panels 1 to create a horizontal challenge and exercise method.

Figure 28A:
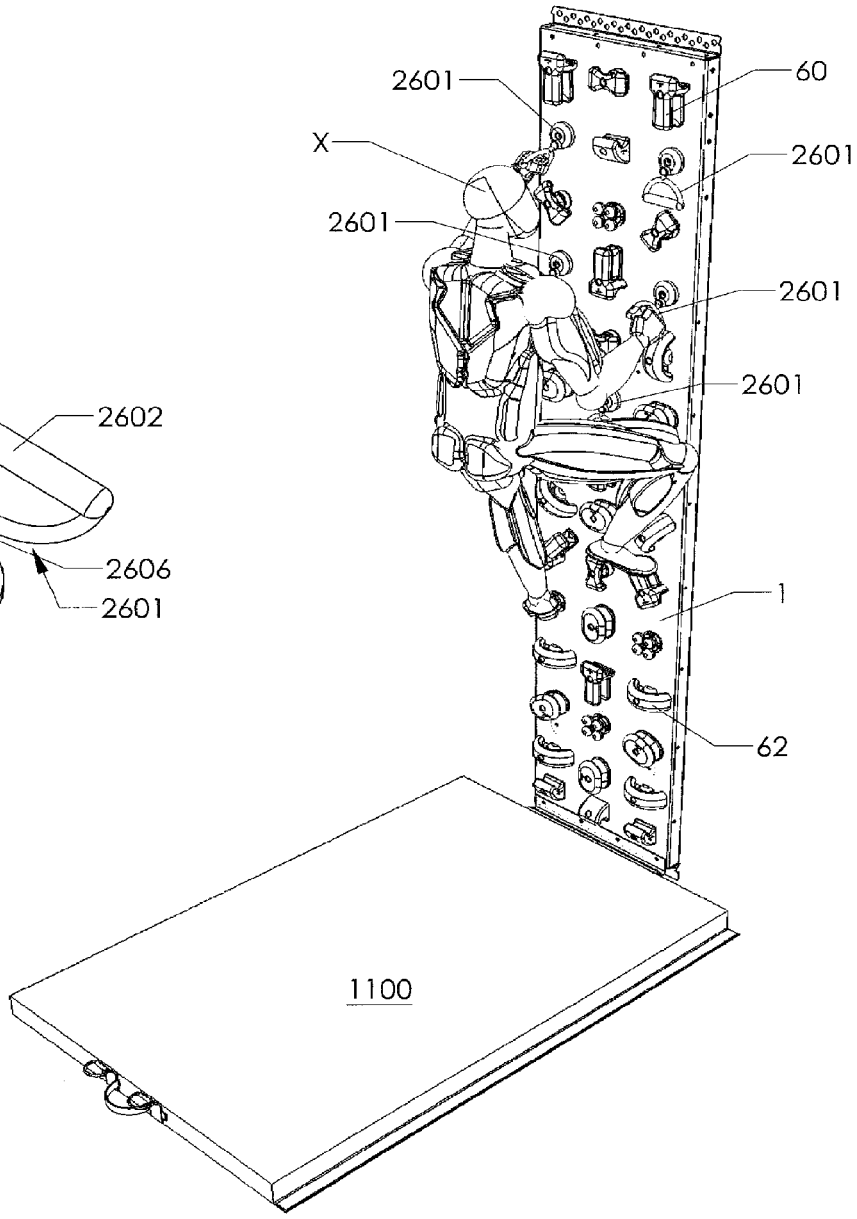
FIG. 28A is a top perspective view of a wall with pivoting and swiveling hand holds.
Figure 28B:
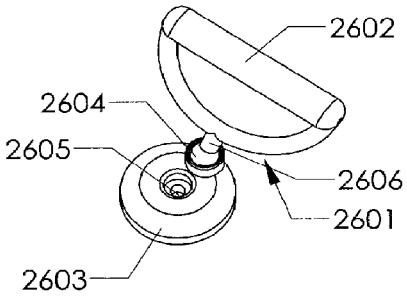
FIG. 28B is a top perspective view of a pivoting and swiveling hold.

Referring next to FIGS. 28A and 28B pivoting holds 2601 can be attached to the fitness wall 1 for specific and controlled exercises. They can be done on one panel 1 or a series of adjoining panels 1 for another innovative horizontal challenge and exercise method. Pivoting holds 2601 can be made can be attached to the panel 1 the same way as discussed above. Anchor hole 2605 allows bolt 701 to attach to hole 25 and threaded receptacle 21. Pivoting hold 2601 has handle 2602 that can be made in a multitude of shapes for user X to hold on to while exercising on the fitness wall. The pivoting hold 2601 has connecting point 2604 pivotally connects handle 2602 to base 2603 allowing the angle of the handle 2602 change during use. The connecting point 2604 can formed to both pivot and swivel, such as with a ball and socket connection, allowing more motion of the handle 2602 in relation to user's hand in use. The handle 2602 can be formed to accommodate the user hands and/or feet. The handle 2602 can be made of rigid or flexible material or a combination thereof. The handle 2602 can have a short or long stem 2606 made either rigid or flexible or both to accommodate the specific need of different exercises and methods of exercising. The stem 2606 can be made adjustable in length. A hold 2601 can be attached to other static surfaces such as, but not limited to, walls, floors and ceilings turning that surface into a platform for a multitude of different and innovative exercise methods.

Figure 29:
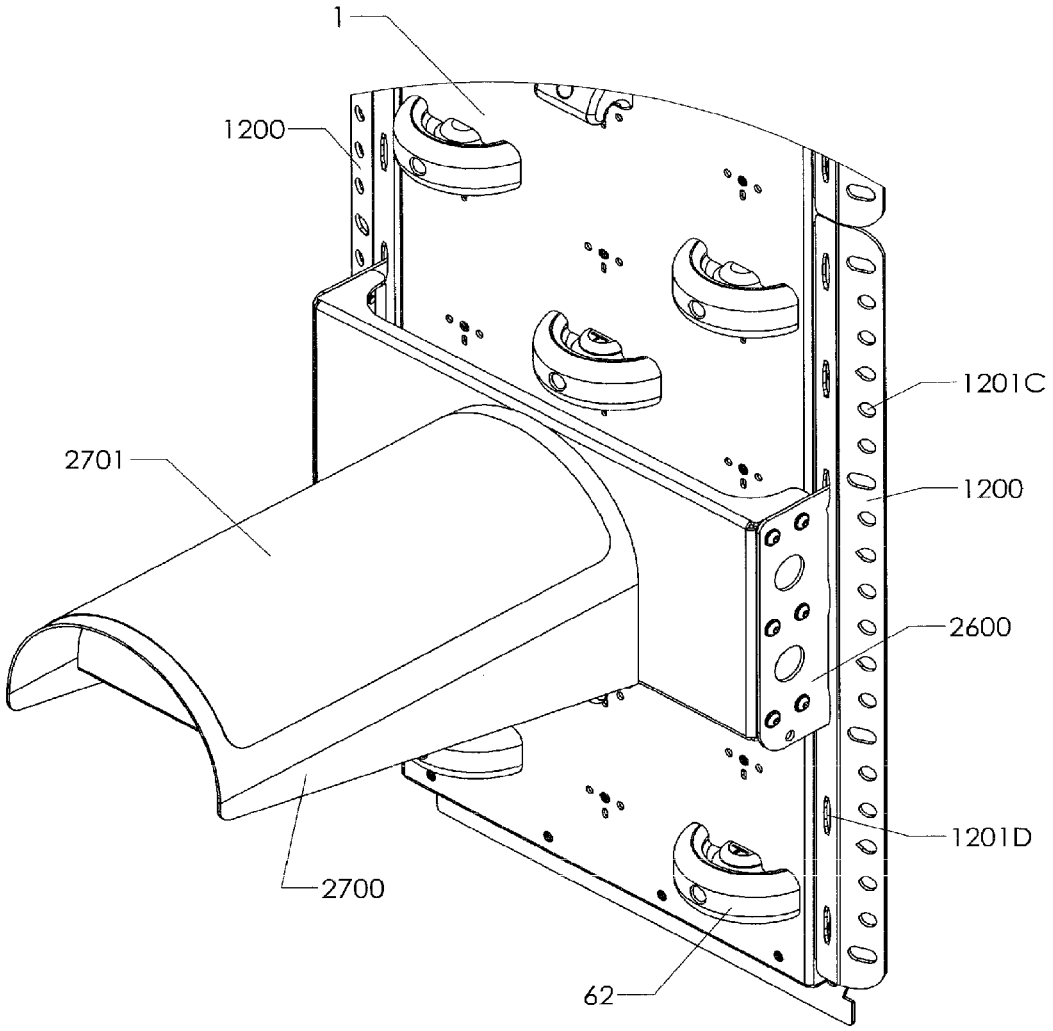
FIG. 29 is a front perspective view of a balance beam attachment.

FIG. 29 shows a balance fixture 2700 is attached to plates 1200 on each side of the panel 1. Plates 1200 allow additional fixtures to be mounted on the fit wall 1 without the use of tools, additional clips or pins. A series of evenly spaced slotted holes 1201D are formed in plates 1200 vertically along the side of the panel 1 are distance d10 apart and have length of d11. Holes 1201 are shaped to allow the specifically shaped anchoring tabs 2600A, 2600B and 2600C to insert into the holes 1201D and then lock a chosen attachment securely. The holes 1201D are spaced on fixture 1200 relative to the distance between the top 2600A and bottom tab 2600B and 2600C as discussed below. The balance fixture 2700 can be adjusted in height from the floor in increments up and down the panel 1. This allows a multitude of exercise options created by the varying levels in height. The balance fixture 2700 can be used for balance and core stabilizing exercises and combined with any other attachment and hand/foot holds as desired. The beam 2700 can have a flat or rounded top surface and have an area on the surface 2701 for which a person can stand and balance themselves while doing a multitude of different exercises using the fitness wall features. The width can be anything desired and conducive to a particular exercise method and its requirements. The beam attachment 2700 can be fixed in a horizontal projecting position or made in such a manner as to be adjusted to or fixed in an angled projection up or downward from the panel 1. Balance fixture 2700 can be made in such a manner as not to interfere or contact any hand holds or handles attached to panel 1.

Figure 30A:
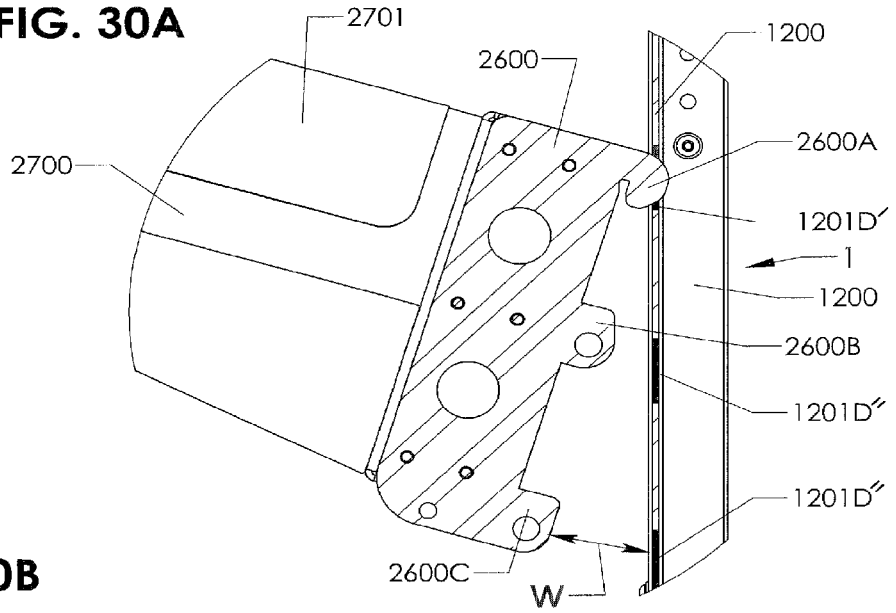
FIGS. 30A, 30B, 30C, 30D, 30E are front perspective views of an attachment fixture and interface method.
Figure 30B:
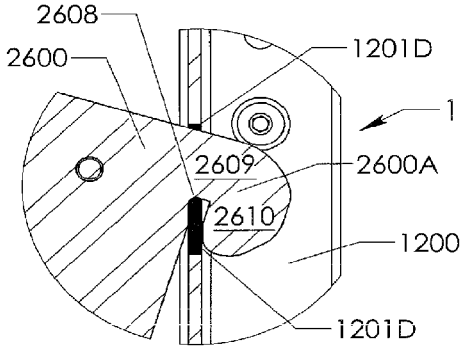
Figure 30C:
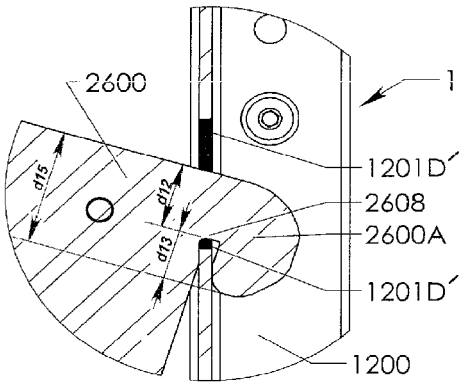

As seen in FIG. 30A, to attach balance fixture 2700 or any other desired attachment on to panel 1, top tabs 2600A are inserted into slots 1201D' on each side of plate 2. The bottom of the fixture is pulled away from panel 1 to allow top tabs 2600A be inserted. The top tab 2600A has with an angled notch 2608, a neck 2609 and a hook 2610 as indicated in FIG. 30B. The formation of top tab 2600A permits the attachment 2700 to pivot at the top tab 2600A as shown by arrow W. This pivot allows the bottom of the fixture to move outward or inward from the fixture 1200 when tab 2600A is fully inserted in a slot 1201D'. Tab 2600A has a height of d15 Tabs 2600B and 2600C have a have a height of d14, as seen in FIG. 30E. The angled notch 2608 has a height of d13 and the neck 2609 has a height of d12 as seen in FIG. 30C. Tabs 2600B and 2600C are spaced a distance d10 apart. The top of angled notch 2608 is also distance d10 from the top of tab 2600B, and the bottom of hook 2610 is a distance d16 from the top of tab 2600B as seen in FIG. 30E. In the depicted embodiment, d10=4", d11=2", d12=¾", d13=¾", d14=1¾", d15=1/½" and d16=3¼". The exact size will depend on the material the system is made from, the amount of weight the system will be rated for and other design consideration. The exact dimensions are not important, but as will be discussed below, the relative sizes to each other are important for proper function.

Referring next to FIG. 30B, after the top tab 2600A is inserted as far into hole 1201D' as it will go, notch 2608 is pushed down vertically as far as it will go onto the receiver holes 1201D' as shown in FIG. 30C. Distance d16 is less than distance d10, so if tab 2600A has not be inserted all the way into hole 1200D and slid down on notch 2608 the tabs 2600B and 2600C will not line up with lower holes 1201D", since holes 1201 are distance d10 apart as seen in FIG. 30A.

Figure 30D:
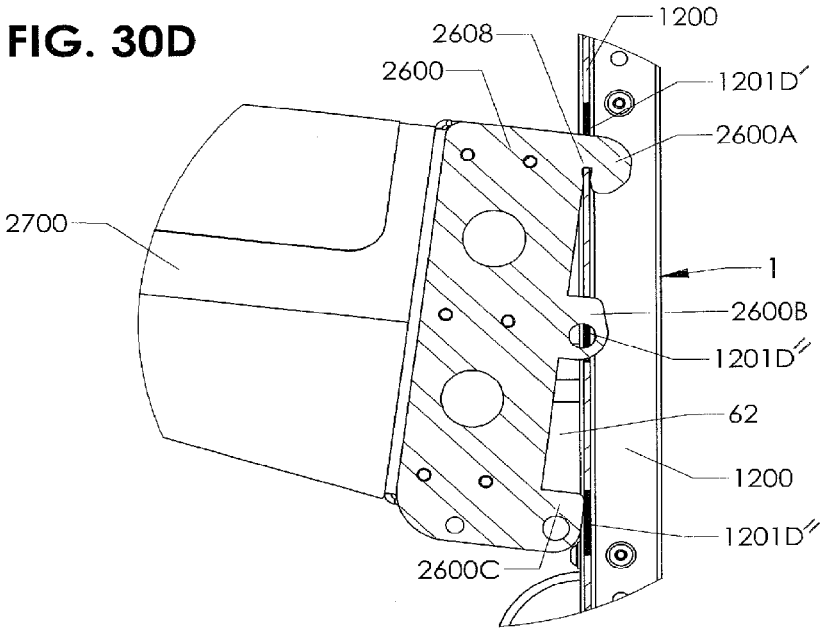
Figure 30E:
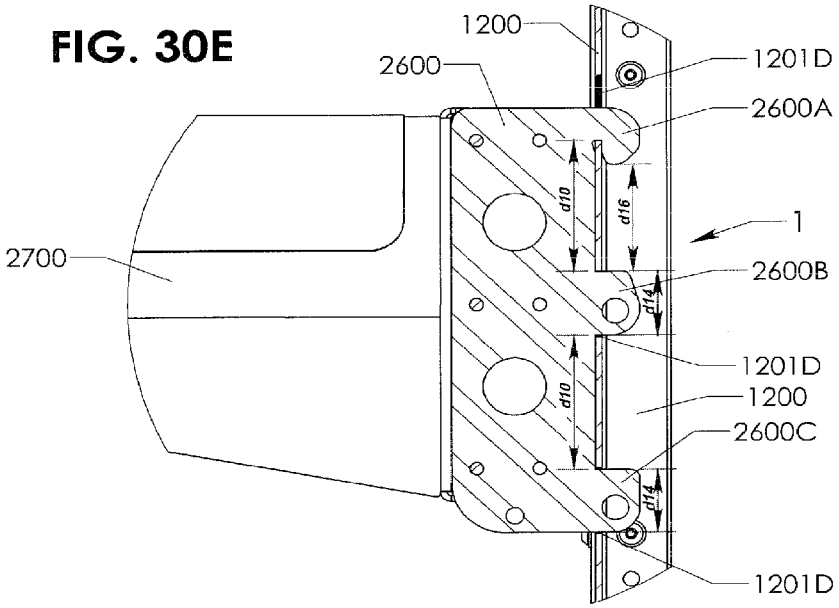

Referring next to FIG. 30D, once the top tab 2600A is locked the bottom tabs 2601B and 2601C will be able to insert into the receiver holes 1201D", since the top of notch 2608 is distance D10 from the top of tab 2600B and tab 2600C is spaced distance d10 from tab 2600B. The bottom of the attachment 2700 is being pushed toward panel 1 to insert the bottom tabs 2600B into the receiver holes 1201D" in brackets 1200 in FIG. 30D. As the bottom tabs 2601B insert into the receiver holes 1201D", the distance d10 between the top of notch 2608 and the top of tab 2600B prevents tabs 2600A on each side from being able to move up vertically as there is no space in holes 1201D". This is due to the fact that the holes 1200*a* are only d11 in height. The height d14 of tabs 2600B and 2600C must be nearly equal to d11. The distance d13 that tab 2600A drops when inserted into hole 1201A must be greater than the difference between d11 and d14. This means that when tabs 2600B, C are inserted into holes 1201D", the fixture cannot be moved upward enough to allow hook 2610 to disengage from hole 1201D'.

Referring next to FIG. 30E the bottom of the attachment 2700 is pushed as far in as it will go. This is the vertical locked position. The attachment 2700 can no longer be lifted straight up, locking the attachment 2700 in a static vertical and horizontal position. As the attachment 2700 is used for exercise the downward force insures that the attachment 2700 is locked in place supported by the tabs 2600A, B and optionally C. The insertion of the tab 2600B also reduces or eliminates any play or movement between the panel 1 and the attachment 2700 when in use. To remove and adjust the height of the attachment 2700 the user pulls the bottom of the attachment away from the fixture 1200 pulling the bottom tab 2600B and 2600C out of the slotted holes 1201D" and lift it straight up on the attachment 2700 to then unlock and free the top tab 2600A and pull it out and free from the fixture 1200 as seen in FIG. 30A.

Figure 31:
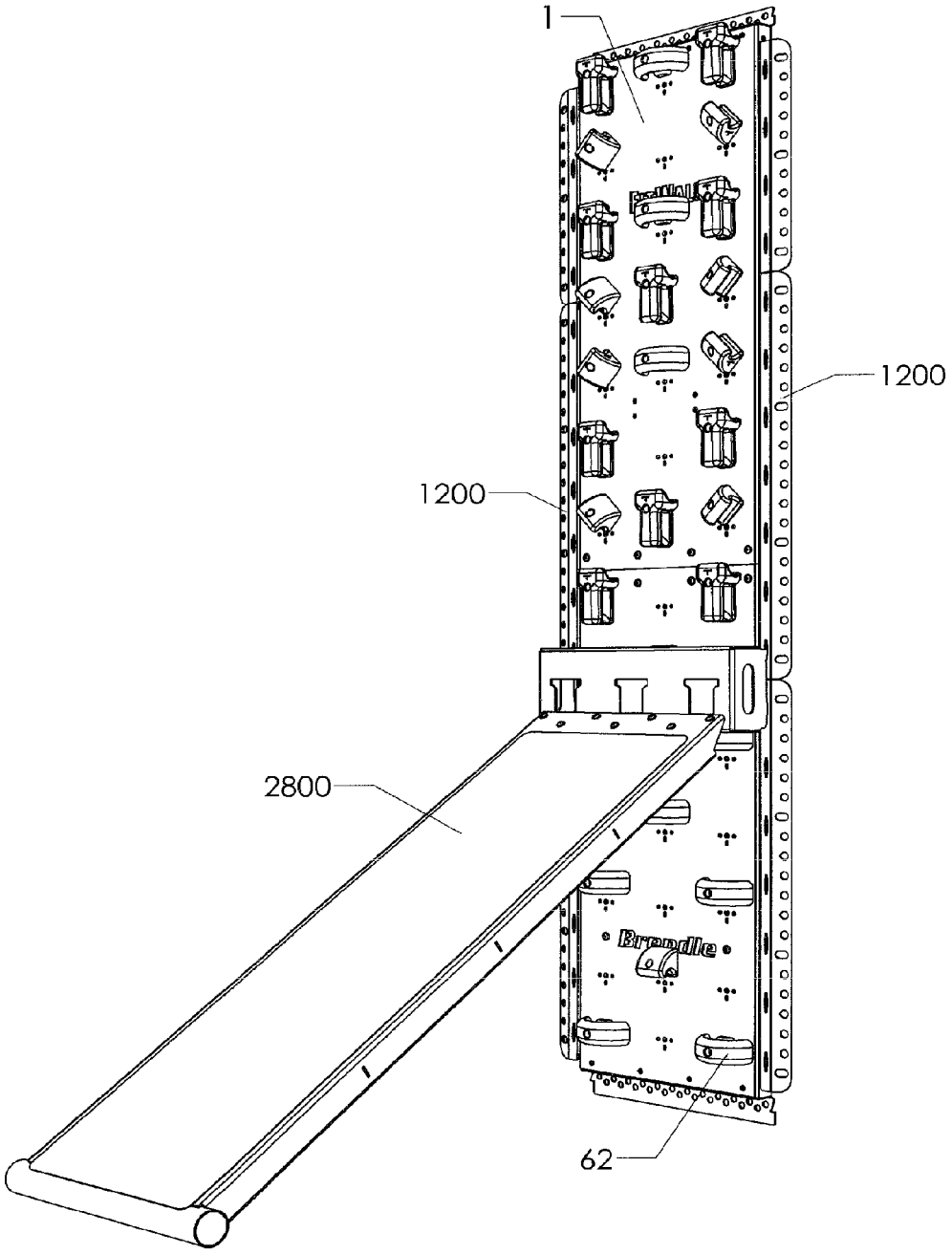
FIG. 31 is a front perspective view of a ramp attachment.

A multitude of different attachments can be utilized with this method quickly and safely, but this method is not the only method that can be used utilized for attachments. Referring next to FIG. 31 an exercise ramp attachment 2800 is shown on panel 1. It can be moved up and down at varying heights on the panel 1. It can be used for balance and core stabilizing exercises and combined with any other attachment and Hand/foot holds for innovative training methods. The ramp 2800 can have a flat or rounded top surface. The width can be anything desired and conducive to a particular exercise method and its requirements. The ramp attachment 2800 can be fixed in a horizontal projecting position or made in such a manner as to be adjusted to or fixed in an angled projection up or downward from the panel 1. A multitude of different attachments can be utilized with this method quickly and safely.

Figure 32:
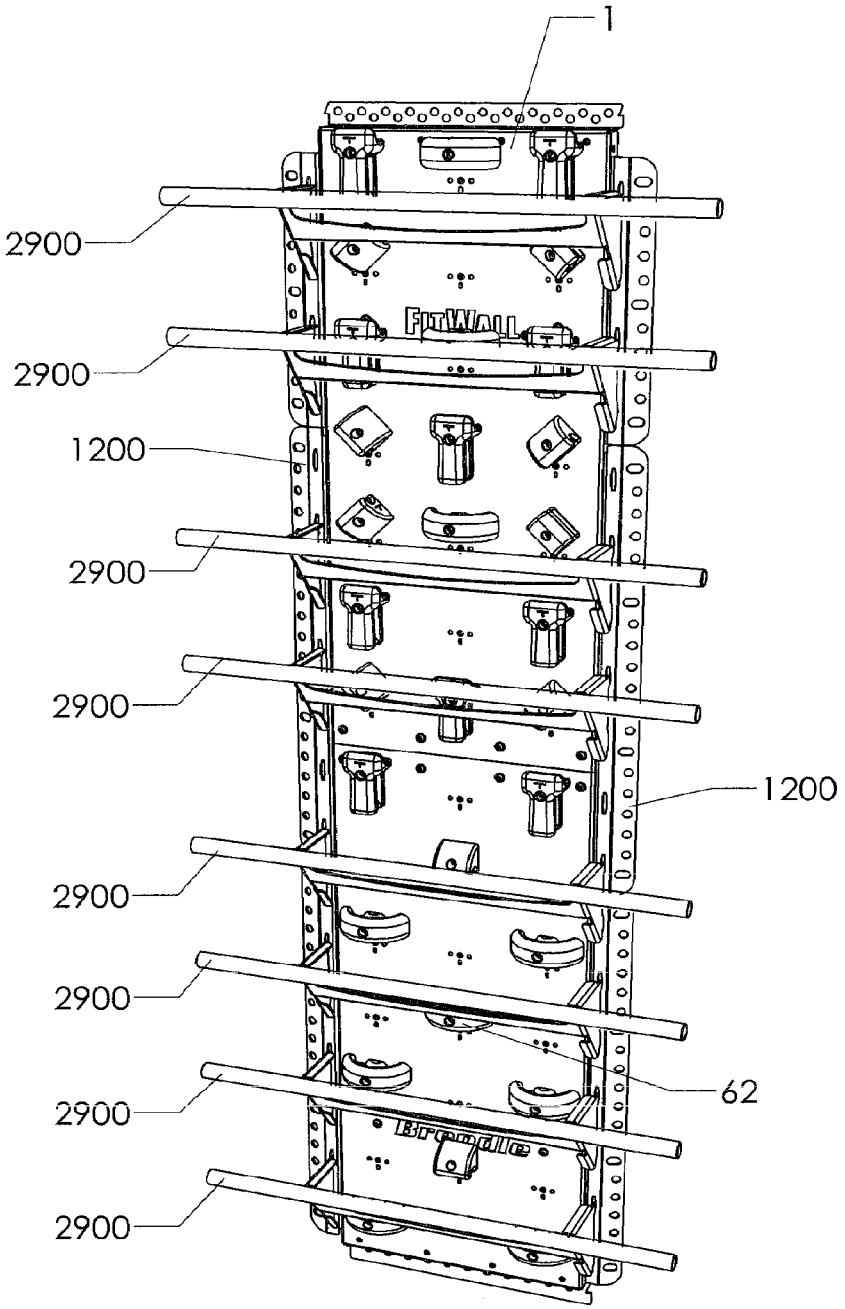
FIG. 32 is a front perspective view of bar attachments mounted on the wall.

Referring next to FIG. 32 a series of bar attachments 2900 can be attached to panel 1 to create and array of bars at equal or varying spaces between them horizontally or vertically. The distance from the face of the panel 1 and the attachments 2900 can vary making select bars stick out farther from the panel. The bar attachments 2900 can increase in space away from the panel 1 evenly as they work up or down the panel to create an angle of bars coming outward from the top or bottom of the panel 1. This will decrease or increase the intensity of the exercise and change the dynamic forces the user will experience. If the bottom bar is set close to the panel 1 and a subsequent bar is set at a higher level and farther away from the panel 1 it will be much more difficult for the user to keep their feet on the lower bar engaging the abdominal and core muscle more intensely. Large diameter bars can be used at the bottom level of the panel 1 for improved foot ergonomics and tractions while a smaller diameter bar is used with the upper level of bars for improved hand ergonomics and grip. A multitude of different attachments can be utilized with the bar quickly and safely, for instance, but not limited to, elastic bands and cables.

The fitness wall can be used by aerobic, yoga, martial arts and other instructors along with personal trainers and strength coaches. In the depicted embodiments the fitness wall is made entirely of metal, steel, aluminum or stainless steel, laser cut with extreme accuracy and has a baked on powder coat finish that is flame, scratch and chip resistant. The entire fitness wall can be sanitized without removing parts and without the threat of moisture (water or cleaning chemicals) deteriorating the product.

Combining the fitness wall with, but not limited to, suspension, plyometrics, step, ballet bar, balance beam, rope, and band training, to mention only a few, will add even more flavor and possibilities in the same floor space. Use of dry erase markers can be used to choreograph training sequences, patterns and body positions or create specific challenges. Use magnetic shapes to mark patterns, sequences and positions or levels of difficulty and quickly change or remove them for the next class or client.

The user's abdominal muscles are constantly engaged and all the other muscles in the body are energized and on call ready to do the unexpected to stay attached to the fitness wall and off the floor. In addition there are always multiple groups of muscles fighting the force of gravity, burning calories, shaping the body, stressing and work hardening tendons and connective tissue, and improving hand/eye coordination and core balance.

The hand/foot holds and handles allow a user to find a good grip demanding less of their fingers, hands and wrists, allowing them to stay on the fitness wall for long periods of time and train more muscles. The fitness wall does not limit a user to just one specific training method for one type of user such as, but not limited to, resistance training, cardio, plyometrics, aerobic, anaerobic, functional, core and many other differing types of sports specific and rehabilitation methods of training. The fitness wall fits all sizes and shapes of users naturally without a person having to fit or conform to it. On the fitness wall specific muscles, and muscle groups, can be targeted and isolated when desired, giving the user the best of both anaerobic and aerobic exercise.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

I claim:

1. A fitness wall comprising:

a flat, rectangular panel having a plurality of flanges extending around a top side, bottom side, left side and right side of the panel, each of the flanges includes openings formed therein;

a first set of mounting brackets attached to the respective flange on each of the top side and the bottom side of the panel and a second set of mounting brackets attached to the respective flanges on each of the left side and right side of panel; each mounting bracket of the first set of mounting brackets on the top side and the bottom side having first holes for mounting the rectangular panel, in a vertical orientation, to a wall; each mounting bracket of the second set of mounting brackets on the left side and right side having second holes for mounting exercise attachments, wherein each mounting bracket in the second set of mounting brackets is a separate part relative to the rectangular panel and is attached to the respective flange with a bolt that passes through the openings formed in the respective flange, each mounting bracket of the second set of mounting brackets being attached such that an entire length of the mounting bracket overlies the respective flange;

wherein the rectangular panel includes a front surface having spaced hole groupings that have more than two holes, wherein each hole grouping is adapted to receive a hand/foot hold inserted into the holes; and wherein the hole groupings are laterally symmetric, and each hole grouping is within two feet of another hole grouping.

2. The fitness wall of claim 1, wherein each hole grouping includes a series of mounting holes and a keying slot and the fitness wall further includes a replacement plate for fixing a damaged mounting hole, the replacement plate comprising a plate body having a plurality of threaded receptacles formed in series along a length of the replacement plate, the threaded receptacles being spaced apart such that each of the threaded receptacles axially aligns with one respective mounting hole when the replacement plate is mounted to the rectangular panel for fixing the damaged mounting hole in the rectangular panel.

3. The fitness wall of claim 2, wherein each hole grouping contains three mounting holes and one keying slot and the replacement plate includes three threaded receptacles that are axially aligned with the three mounting holes when the replacement plate is mounted to the rectangular panel.

4. The fitness wall of claim 3, wherein the replacement plate is configured to leave open the keying slot when the replacement plate is mounted to the rectangular panel.

5. The fitness wall of claim 3, wherein the replacement plate is mounted along a rear surface of the rectangular plate.

6. The fitness wall of claim 3, wherein each threaded receptacle is disposed within one respective mounting hole.

7. The fitness wall of claim 1 wherein each hole grouping is adapted to receive multiple different types of hand/foot holds.

8. The fitness wall of claim 1 wherein each hole grouping is adapted to receive a hand/foot hold that includes a rope.

9. The fitness wall of claim 1 wherein each hole grouping is adapted to receive a hand/foot hold that includes a rotating and pivoting grip piece.

10. The fitness wall of claim 1, wherein the second holes comprise a first series of holes for aligning with respective openings in the respective flange to permit the bolt to pass through and a second series of holes configured for mounting the exercise attachments.

11. The fitness wall of claim 1, wherein each mounting bracket of the seconds set of mounting brackets is configured to be attachable to the respective flange in a plurality of different positions so as to alter a relative position of the holes formed of the mounting bracket relative to the openings in the flange in which the mounting bracket is attached.

12. The fitness wall of claim 1, wherein a length of each of the mounting brackets of the second set of mounting brackets has a length that is less than a length of the respective flange to which the mounting bracket is attached.

13. A fitness wall comprising:

a flat, rectangular panel having a plurality of flanges extending around a top, bottom, left side and right side of the panel, each of the flanges includes openings formed therein;

a first set of mounting brackets attached to the respective flange on each of the top side and bottom side of the panel and a second set of mounting brackets attached to the respective flanges on each of the left side and right side of the rectangular panel; each mounting bracket of the first set of mounting brackets on the top side and the bottom side having first holes for mounting the panel, in a vertical orientation, to a wall; each mounting bracket of the second set of mounting brackets on the left side and right side having second holes for mounting exercise attachments, wherein each mounting bracket in the second set of mount brackets is a separate part relative to the rectangular panel and is attached to the respective flange;

wherein the rectangular panel includes a front surface having spaced hole groupings that includes a plurality of mounting holes and a keying slot, wherein each hole grouping is adapted to receive a hand/foot hold inserted into at least one mounting hole and one keying slot; and a replacement plate for fixing a damaged mounting hole, the replacement plate comprising a plate body having a plurality of threaded receptacles formed in series along a length of the replacement plate, the threaded receptacles being spaced apart such that each of the threaded receptacles axially aligns with one respective mounting hole when the replacement plate is mounted to the rectangular panel for fixing the damaged mounting hole in the rectangular panel.

14. The fitness wall of claim 13, wherein each hole grouping contains three mounting holes and one keying slot and the replacement plate includes three threaded receptacles that are axially aligned with the three mounting holes when the replacement plate is mounted to the rectangular panel.

15. The fitness wall of claim 14, wherein the replacement plate is configured to leave open the keying slot when the replacement plate is mounted to the rectangular panel.

16. The fitness wall of claim 14, wherein the replacement plate is mounted along a rear surface of the rectangular plate.

17. The fitness wall of claim 14, wherein each threaded receptacle is disposed within one respective mounting hole.

* * * * *